US011081039B2

(12) United States Patent
Park et al.

(10) Patent No.: US 11,081,039 B2
(45) Date of Patent: Aug. 3, 2021

(54) DISPLAY DEVICE AND METHOD OF DRIVING THE SAME

(71) Applicant: Samsung Display Co., Ltd., Yongin-si (KR)

(72) Inventors: Jong Woong Park, Yongin-si (KR); Jae Gwan Jeon, Yongin-si (KR); Nam Gon Choi, Yongin-si (KR)

(73) Assignee: SAMSUNG DISPLAY CO., LTD.

( * ) Notice: Subject to any disclaimer, the term of this patent is extended or adjusted under 35 U.S.C. 154(b) by 0 days.

(21) Appl. No.: 16/733,854

(22) Filed: Jan. 3, 2020

(65) Prior Publication Data

US 2020/0219432 A1 Jul. 9, 2020

(30) Foreign Application Priority Data

Jan. 4, 2019 (KR) ..... 10-2019-0001259
Sep. 10, 2019 (KR) ..... 10-2019-0112198

(51) Int. Cl.
*G09G 3/20* (2006.01)

(52) U.S. Cl.
CPC ..... *G09G 3/2003* (2013.01); *G09G 3/2007* (2013.01); *G09G 2320/0204* (2013.01); *G09G 2320/0242* (2013.01)

(58) Field of Classification Search
CPC ..... G09G 3/2003; G09G 3/2007; G09G 2320/0204; G09G 2320/0242
See application file for complete search history.

(56) References Cited

U.S. PATENT DOCUMENTS 7,675,492 B2 3/2010 Park et al.
2007/0273686 A1* 11/2007 Watanabe ..... G06T 15/506 345/419
2014/0052555 A1* 2/2014 Macintosh ..... G06K 9/00664 705/23
2014/0285533 A1* 9/2014 Chun ..... G09G 3/3208 345/690

FOREIGN PATENT DOCUMENTS

KR 10-2014-0116690 10/2014

* cited by examiner

*Primary Examiner* — Robert J Michaud
(74) *Attorney, Agent, or Firm* — H.C. Park & Associates, PLC

(57) ABSTRACT

A display device includes a display unit including a plurality of pixels, a data converter to receive grayscale values respectively corresponding to the plurality of pixels, generate first compensated grayscale values by remapping the grayscale values of a first grayscale range to the first compensated grayscale value of a second grayscale range, and generate second compensated grayscale values by compensating for the first compensated grayscale values based on first compensated grayscale values of adjacent pixels, and a data driver to generate data signals based on the second compensated grayscale values and provide the data signals to the plurality of pixels of display unit, wherein adjacent pixels of a target pixel correspond to pixels adjacent to the target pixel, and wherein at least one of the adjacent pixels emits light having a color different from that of the target pixel.

22 Claims, 18 Drawing Sheets

FIG. 7

| GRAY_IN | GRAY_RE |
|---|---|
| 32 | 32.000 |
| 31 | 31.000 |
| 30 | 30.000 |
| 29 | 29.000 |
| 28 | 28.000 |
| 27 | 27.500 |
| 26 | 27.000 |
| 25 | 26.000 |
| 24 | 25.000 |
| 23 | 24.500 |
| 22 | 24.000 |
| 21 | 23.000 |
| 20 | 22.500 |
| 19 | 22.000 |
| 18 | 21.500 |
| 17 | 21.000 |
| 16 | 20.000 |
| 15 | 19.500 |
| 14 | 19.000 |
| 13 | 18.500 |
| 12 | 18.000 |
| 11 | 17.500 |
| 10 | 17.000 |
| 9 | 16.750 |
| 8 | 16.250 |
| 7 | 16.000 |
| 6 | 15.750 |
| 5 | 15.250 |
| 4 | 15.000 |
| 3 | 14.750 |
| 2 | 14.500 |
| 1 | 14.250 |
| 0 | 14.000 |

FIG. 9A

FILTER1

| | | |
|---|---|---|
| a1 | a2 | a3 |
| a4 | a0 | a5 |
| a6 | a7 | a8 |

FIG. 9B

FILTER_S1

| | | |
|---|---|---|
| 0.05 | 0.1 | 0.05 |
| 0.125 | 0 | 0.125 |
| 0.05 | 0.1 | 0.05 |

FILTER_S2

| | | |
|---|---|---|
| 0.025 | 0.05 | 0.025 |
| 0.1 | 0 | 0.1 |
| 0.025 | 0.05 | 0.025 |

FILTER_L1

| | | |
|---|---|---|
| c1 | c2 | c3 |

FILTER_L2

| | | | | |
|---|---|---|---|---|
| d1 | d2 | d0 | d3 | d4 |

FILTER_L3

| | | | | | |
|---|---|---|---|---|---|
| e1 | e2 | e3 | e0 | e4 | e5 |

DISPLAY DEVICE AND METHOD OF DRIVING THE SAME

CROSS-REFERENCE TO RELATED APPLICATION

This application claims priority from and the benefit of Korean Patent Application No. 10-2019-0001259, filed on Jan. 4, 2019 and Korean Patent Application No. 10-2019-0112198 filed on Sep. 10, 2019, which are hereby incorporated by reference for all purposes as if fully set forth herein.

BACKGROUND

Field

The invention relates generally to a display device and a method of driving the display device and, more particularly, to a display device and driving method capable of compensating for leakage current in the pixels of the display.

Discussion of the Background

A display device displays an image on a display panel using externally applied control signals.

Generally, a display device may include a red pixel, a green pixel, and a blue pixel, wherein a color at a specific point (or in a specific area) may be determined by a temporal or spatial sum of light components emitted from the red pixel, the green pixel, and the blue pixel.

In a low grayscale range having relatively low grayscale values, the gamma characteristics of individual pixels and white balance of the pixels may be degraded or distorted, and an image may not be accurately displayed with desired luminance and/or colors.

The above information disclosed in this Background section is only for understanding of the background of the inventive concepts, and, therefore, it may contain information that does not constitute prior art.

SUMMARY

Applicant discovered that leakage current in pixels may degrade image quality and/or color, especially in the low grayscale range. Display devices constructed according to and methods employing exemplary implementations of the invention can prevent or reduce the deterioration of display quality in a low grayscale range.

Additional features of the inventive concepts will be set forth in the description which follows, and in part will be apparent from the description, or may be learned by practice of the inventive concepts.

According to one or more embodiments of the invention, a display device includes a display unit including a plurality of pixels, a data converter to receive grayscale values respectively corresponding to the plurality of pixels, generate first compensated grayscale values by remapping the grayscale values of a first grayscale range to the first compensated grayscale value of a second grayscale range, and generate second compensated grayscale values by compensating for the first compensated grayscale values based on first compensated grayscale values of adjacent pixels, and a data driver to generate data signals based on the second compensated grayscale values and provide the data signals to the plurality of pixels of display unit, wherein adjacent pixels of a target pixel correspond to pixels adjacent to the target pixel, and wherein at least one of the adjacent pixels emits light having a color different from that of the target pixel.

The first grayscale range is a subset of the second grayscale range.

The first grayscale range may include a first low grayscale range and the second grayscale range may include a second low grayscale range, the first low grayscale range being a subset of the second low grayscale, and the data converter may remap the grayscale values in the first low grayscale range the first compensated grayscale value in the second low grayscale range.

The data converter may generate the first compensated grayscale values based on a lookup table including mapping information between the first low grayscale values and the second low grayscale values.

The data converter may generate a second compensated grayscale value of the target pixel by decreasing a first compensated grayscale value of the target pixel in response to one of the adjacent grayscale values being increased.

The data converter may calculate a compensation value for the target pixel based on the first compensated grayscale values of the adjacent pixels, and calculate the second compensated grayscale value of the target pixel by subtracting the compensation value from the first compensated grayscale value of the target pixel.

The data converter may calculate the compensation value by computing a weighted sum of the first compensated grayscale values of the adjacent pixels based on preset compensation coefficients.

A first compensation coefficient corresponding to a first adjacent pixel of the adjacent pixels that is in a row identical to that of the target pixel may be different from a second compensation coefficient corresponding to a second adjacent pixel of the adjacent pixels that is in a column identical to that of the target pixel.

The first compensation coefficient may be greater than the second compensation coefficient.

The compensation value may be inversely proportional to the first compensated grayscale value.

The first compensation value may be inversely proportional to a total maximum luminance of the plurality of pixels.

The plurality of pixels may include a first pixel to emit light in a first color, a second pixel to emit light in a second color, and a third pixel to emit light in a third color, the data converter may calculate a first compensation value of the first pixel using a first compensation filter including first compensation coefficients and calculate a second compensation value of the second pixel using a second compensation filter including second compensation coefficients, and the second compensation filter may be different from the first compensation filter.

The adjacent pixels may be included in the same row as that of the target pixel.

According to one or more embodiments of the invention, a method of driving a display device may include generating first compensated grayscale values by remapping respective input grayscale values from a first grayscale range to a second grayscale range, generating second compensated grayscale values by compensating for remapped grayscale values based on remapped grayscale values of adjacent pixels, and generating data signals based on the second compensated grayscale values, wherein the adjacent pixels of a target pixel corresponds to pixels arranged adjacent to the target pixel, and wherein at least one of the adjacent pixels emits light having a color different from that of the target pixel.

In response to one of the adjacent grayscale values being increased, the second compensated grayscale value of the target pixel may be decreased.

The generating of the first compensated grayscale values may include determining a global gain for the target pixel based on a first compensated grayscale value of the target pixel, and calculating a second compensated grayscale value of the target pixel based on the global gain and the first compensated grayscale values of the adjacent grayscale.

According to one or more embodiments of the invention, a display device may include a display unit including a plurality of pixels, a data converter to receive grayscale values respectively corresponding to the plurality of pixels, remap the grayscale values of a first grayscale range to first compensated grayscale values of a second grayscale range, and generate second compensated grayscale values by compensating for the grayscale values based on first compensated grayscale values of adjacent pixels, and a data driver to generate data signals based on the second compensated grayscale values and provide the data signals to the plurality of pixels, wherein the adjacent pixels of a target pixel correspond to pixels adjacent to the target pixel, and wherein at least one of the adjacent pixels is configured to emit light in a color different from that of the target pixel.

The second grayscale range may be a subset of the first grayscale range.

The data converter may be configured to calculate a difference value by subtracting a grayscale value of the target pixel from a first compensated grayscale value of the target pixel, calculate a first compensation value for the target pixel based on the first compensated grayscale values of the adjacent pixels, calculate a second compensation value by subtracting the first compensation value from an absolute value of the difference value, and calculate a second compensated grayscale value of the target pixel based on the grayscale value and the second compensation value, and the data converter may be configured to increase the first compensation value as one of the first compensated grayscale values of the adjacent pixels is increased.

The data converter may be configured to set the first compensation value to the second compensated grayscale value in response to the first compensation value being less than 0.

The data converter may be configured to calculate the first compensation value by computing a weighted sum of the adjacent grayscale values based on compensation coefficients that are preset in accordance with the respective adjacent grayscale values.

A first compensation coefficient for a first adjacent pixel of the adjacent pixels that is in a row identical to that of the target pixel may be different from a second compensation coefficient for a second adjacent pixel of the adjacent pixels that is in a column identical to that of the target pixel, among the adjacent pixels.

The data converter may be configured to calculate the second compensated grayscale value by adding the first compensated grayscale value to the second compensation value in response to the difference value being greater than 0.

The data converter may be configured to calculate the second compensated grayscale value by subtracting the second compensation value from the first compensated grayscale value in response to the difference value being less than 0.

The first compensation value may be proportional to the grayscale value of the target pixel and may be inversely proportional to the first compensated grayscale value.

The display device and the method of driving the display device according to embodiments of the invention may compensate for the degradation of gamma characteristics of respective pixels by remapping grayscale values in a low grayscale range, and may correct distortion (improperness) in white balance of the pixels by compensating for the remapped grayscale values based on adjacent grayscale values. Therefore, the deterioration of display quality in a low grayscale range may be mitigated or prevented.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

FIG. 7 is a diagram illustrating an example of a lookup table that may be used in the first data compensator in the controller of FIG. 5.

FIG. 9A is a diagram illustrating an example of a compensation filter used in a second data compensator in the controller of FIG. 5.

FIG. 9B is a diagram illustrating embodiments of the compensation filter of FIG. 9A.

DETAILED DESCRIPTION

Figure 1:
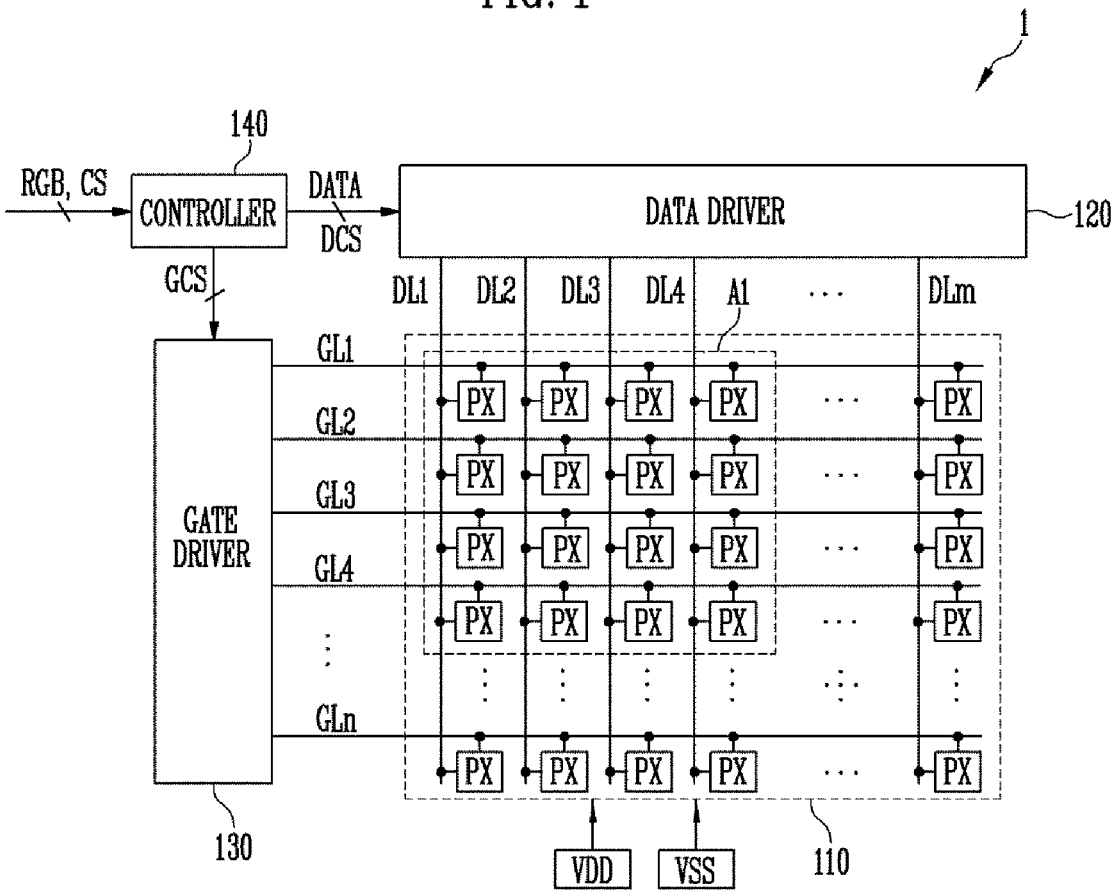
FIG. 1 is a block diagram of a display device constructed according to an exemplary embodiment of the invention.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

In the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, embodiments of the invention will be described in detail with reference to the attached drawings, such that those skilled in the art can easily practice the invention. The invention may be embodied in various different forms without being limited to the following embodiments.

Furthermore, in the drawings, portions which are not related to the invention will be omitted to explain the invention more clearly. Reference should be made to the drawings, in which similar reference numerals are used throughout the different drawings to designate similar components. Therefore, the above-described reference numerals may also be used in other drawings.

FIG. 1 is a block diagram of a display device constructed according to an exemplary embodiment of the invention.

Referring to FIG. 1, a display device 1 may include a display unit 110, a data driver 120, a gate driver 130, and a controller 140.

The display unit 110 may display an image. The display unit 110 may be implemented as a display panel.

The display unit 110 may include data lines DL1 to DLm (where m is a positive integer), gate lines GL1 to GLn (where n is a positive integer), and pixels PX. The pixels PX may be arranged in an area divided by the data lines DL1 to DLm and the gate lines GL1 to GLn. The pixels PX may be electrically coupled to the data lines DL1 to DLm and the gate lines GL1 to GLn.

For example, a pixel PX disposed in a first row and a first column may be coupled to the first data line DL1 and the first gate line GL1. For example, a pixel PX disposed in an n-th row and an m-th column may be coupled to the m-th data line DLm and the n-th gate line GLn.

However, the coupling of the pixels PX is not limited thereto. For example, each pixel PX may be electrically coupled to gate lines corresponding to adjacent rows (e.g., a gate line corresponding to a row previous to a row including the corresponding pixel PX and a gate line corresponding to a next row). Further, although not illustrated in the drawing, the pixels PX may be electrically coupled to a first power line and a second power line, and may then receive a first supply voltage VDD and a second supply voltage VSS. Here, the first supply voltage VDD and the second supply voltage VSS may be voltages required for driving of the pixels PX.

Each pixel PX may emit light with luminance corresponding to a data signal provided through the corresponding data line in response to a gate signal provided through the corresponding gate line. The configuration and operation of each pixel PX will be described in detail later with reference to FIG. 2.

The data driver 120 may generate data signals based on a data control signal DCS and image data DATA, and may provide the data signals to the data lines DL1 to DLm. Here, the data control signal DCS may be a signal for controlling the operation of the data driver 120, and may include a data enable signal and the like.

The data driver 120 may be implemented as an Integrated Circuit (IC) (e.g., driving IC), and may be mounted on a flexible printed circuit board (FPCB) and then coupled to the display unit 110.

The gate driver 130 (or scan driver) may generate gate signals in response to a gate control signal GCS, and may provide the gate signals to the gate lines GL1 to GLn. Here, the gate control signal GCS may be a signal for controlling the operation of the gate driver 130, and may include an initiation signal, clock signals, etc. For example, the gate driver 130 may sequentially generate and output gate signals (e.g. gate signals having a waveform identical or similar to that of the initiation signal) corresponding to the initiation signal using the clock signals. The gate driver 130 may include a shift register. The gate driver 130 may be formed on a region of the display unit 110 (or a region of the display panel), or may be implemented as an IC and may be mounted on a flexible printed circuit board (FPCB) and then coupled to the display unit 110.

The controller 140 may be receive input image data RGB (e.g., RGB data) and a control signal CS from an external device (e.g., graphic processor), and may generate the gate control signal GCS and the data control signal DCS in response to the control signal CS. Here, the input image data RGB may include grayscale values corresponding to the pixels PX.

The control signal CS may include a clock signal, a horizontal synchronization signal, a data enable signal, etc.

Further, the controller 140 may convert the input image data RGB into image data DATA matching the pixel array of the display unit 110 and output the image data DATA to the data driver 120.

In exemplary embodiments, the controller 140 may remap each grayscale value, included in the input image data RGB, from a first grayscale range to a second grayscale range, and then generate a remapped grayscale value (or a first compensated grayscale value). Here, the second grayscale range may be narrower than the first grayscale range. Particularly, the first grayscale range may encompass the second grayscale range. For example, the controller 140 may remap a grayscale value from the first grayscale range from a grayscale value of 0 to a grayscale value of 255 to the second grayscale range from a grayscale value of 14 to a grayscale value of 255.

Furthermore, the controller 140 may compensate for the remapped grayscale value of a target pixel based on adjacent grayscale values, and may then generate a compensated grayscale value (or a second compensated grayscale value) of the target pixel. Here, the adjacent grayscale values may be grayscale values (i.e., remapped grayscale values) corresponding to adjacent pixels arranged adjacent to the target pixel (i.e., pixel PX corresponding to a grayscale value which is to be compensated for), and at least one of the adjacent pixels may emit light that may emit light in a color different from that of the target pixel. For example, pixels adjacent to a pixel included in a second row and a second column may be at least one of pixels arranged in an area in which first to third rows and first to third columns intersect (or in a first area A1 illustrated in FIG. 1).

In an embodiment, the controller 140 may compensate for the grayscale value based on the remapped grayscale value and adjacent grayscale values (or the remapped grayscale values of the adjacent pixels), and may generate the compensated grayscale value (or the second compensated grayscale value).

In an exemplary embodiment, the controller 140 may generate the compensated grayscale value of the target pixel by decreasing the remapped grayscale value of the target pixel as at least one of the adjacent grayscale values is increased.

Below, grayscale remapping, which allows the controller 140 to remap grayscale values, and grayscale compensation will be described in relation to the structure of the pixel PX.

Although the controller 140 is illustrated as being implemented independently of the data driver 120 in FIG. 1, the controller 140 is not limited thereto. For example, the controller 140 may be integrated with the data driver 120 into a single IC, or may be included in the data driver 120.

Figure 2:
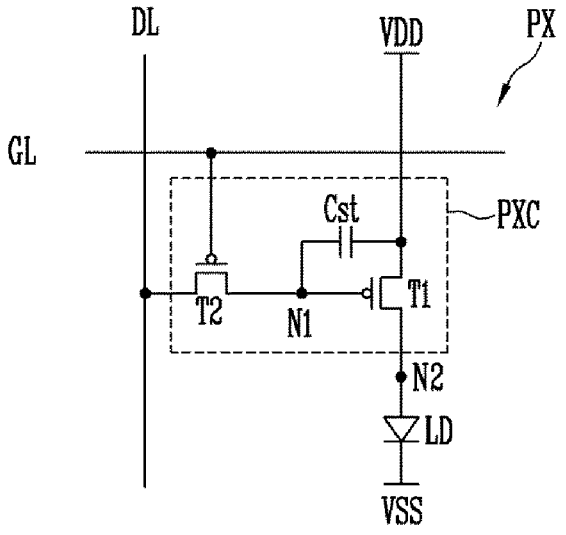
FIG. 2 is a circuit diagram illustrating an equivalent circuit of an exemplary pixel in the display device of FIG. 1.
Figure 3:
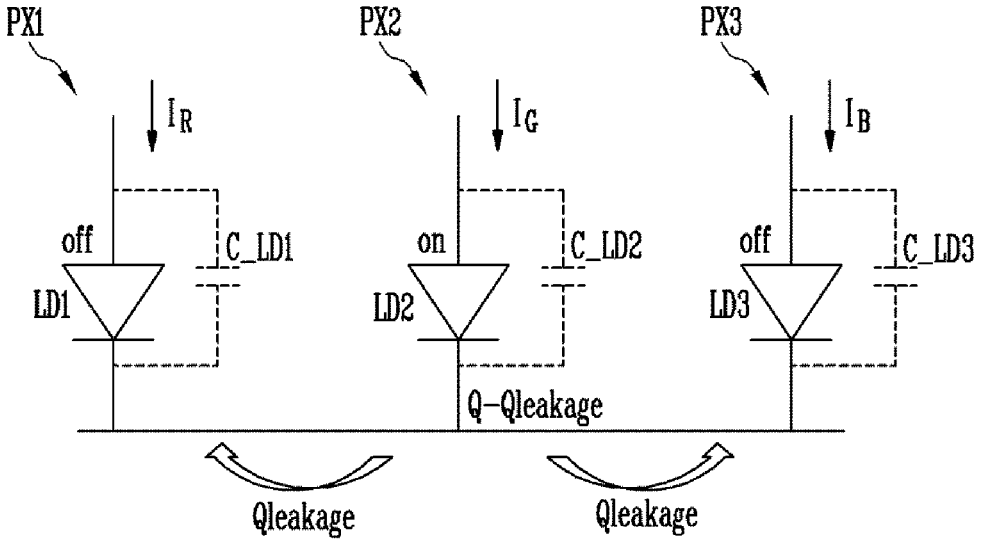
FIG. 3 is a partial circuit diagram illustrating a relationship between a pixel and adjacent pixels of FIG. 2.

FIG. 2 is a circuit diagram illustrating an equivalent circuit of an exemplary pixel in the display device of FIG. 1. FIG. 3 is a partial circuit diagram illustrating a relationship between the pixel and adjacent pixels of FIG. 2.

Referring to FIGS. 1 and 2, a pixel PX may include a first transistor T1, a second transistor T2, a storage capacitor Cst, and a light-emitting element LD.

The first transistor T1 and the second transistor T2 may be implemented as P-type transistors (e.g., PMOS transistors), but are not limited thereto. For example, at least one of the first transistor T1 and the second transistor T2 may be implemented as an N-type transistor (e.g., NMOS transistor). Also, the pixel PX may further include additional transistors in addition to the first transistor T1 and the second transistor T2.

The first transistor T1 (or driving transistor) may include a first electrode coupled to a first power line to which a first supply voltage VDD is applied, a second electrode coupled to a second node N2, and a gate electrode coupled to a first node N1.

The second transistor T2 (or switching transistor) may include a first electrode coupled to a data line DL, a second electrode coupled to the first node N1, and a gate electrode coupled to a gate line GL. Here, the data line DL may be one of the data lines DL1 to DLm illustrated in FIG. 1, and the gate line GL may be one of the gate lines GL1 to GLn illustrated in FIG. 1.

The second transistor T2 may be turned on in response to a gate signal provided through the gate line GL, and may transfer a data signal provided through the data line DL to the first node N1. For example, the gate signal may be a pulse signal having a turn-on voltage level for turning on the corresponding transistor.

The storage capacitor Cst may be coupled between the first node N1 and the first power line (i.e., power line to which the first supply voltage VDD is applied). The storage capacitor Cst may temporarily store the data signal that is applied to the first node N1. In this case, the first transistor T1 may control the amount of driving current flowing from the first power line into the second node N2 in response to the data signal stored in the storage capacitor Cst.

The light-emitting element LD (or light-emitting diode) may include an anode electrode (or a first pixel electrode) coupled to the second node N2 and a cathode electrode (or a second pixel electrode) coupled to a second power line to which a second supply voltage VSS is applied. For example, the light-emitting element LD may be an organic light-emitting diode or an inorganic light-emitting diode. The light-emitting element LD may emit light with luminance corresponding to the driving current (or the amount of driving current).

Referring to FIG. 3, pixels PX1, PX2, and PX3 which are adjacent to each other around the light-emitting element LD illustrated in FIG. 2 are illustrated schematically. The pixels PX1, PX2, and PX3 may be sub-pixels included in the display unit 110 of FIG. 1, and may have substantially the same design as the pixel PX of FIG. 2.

In exemplary embodiments, the first pixel PX1 may include a first light-emitting element LD1 for emitting light in a first color, the second pixel PX2 may include a second light-emitting element LD2 for emitting light in a second color, and the third pixel PX3 may include a third light-emitting element LD3 for emitting light in a third color. For example, the first light-emitting element LD1 may emit light in red, the second light-emitting element LD2 may emit light in green, and the third light-emitting element LD3 may emit light in blue. The first, second, and third light-emitting elements LD1, LD2, and LD3 may include first to third parasitic capacitors C_LD1, C_LD2, and C_LD3, respectively.

Assuming that a driving current does not flow through the first pixel PX1 and the third pixel PX3 adjacent to the second pixel PX2 (i.e., $I_R$=0 and $I_B$=0) while the driving current $I_G$ is supplied to the second pixel PX2, at least a part of the second driving current $I_G$ flowing through the second pixel PX2 may leak to the first pixel PX1 and the third pixel PX3 along a common layer of the first to third light-emitting elements LD1, LD2, and LD3 (e.g., layer included in common in the first to third light-emitting elements LD1, LD2, and LD3 or layers adjacent to the first to third light-emitting elements LD1, LD2, and LD3). Hereinafter, such leakage is referred to as "lateral leakage". That is, a leakage charge Qleakage moving from the second pixel PX2 to the first and third pixels PX1 and PX3 occurs, and the second pixel PX2 may emit light with luminance lower than desired luminance due to the reduced charge of Q-Qleakage.

When the second driving current $I_G$ is substantially greater than the leakage current (or when the total charge Q is greater than the leakage charge Qleakage), the rate at which luminance is decreased may be low, and the corresponding decrease in the luminance may not be perceivable or noticeable to a user. In contrast, when the second driving current $I_G$ is substantially low, the rate at which luminance is decreased may be relatively high, and thus the corresponding decrease in the luminance may be perceivable or noticeable to the user. That is, in a low-current region in which the driving current is relatively low (or in a low luminance region having a relatively low luminance corresponding to the relatively low driving current or in a low grayscale range in which the magnitudes of grayscale values are relatively small), the light emission characteristics of the pixels may be degraded or a gamma curve may be downwardly shifted.

Figure 4:
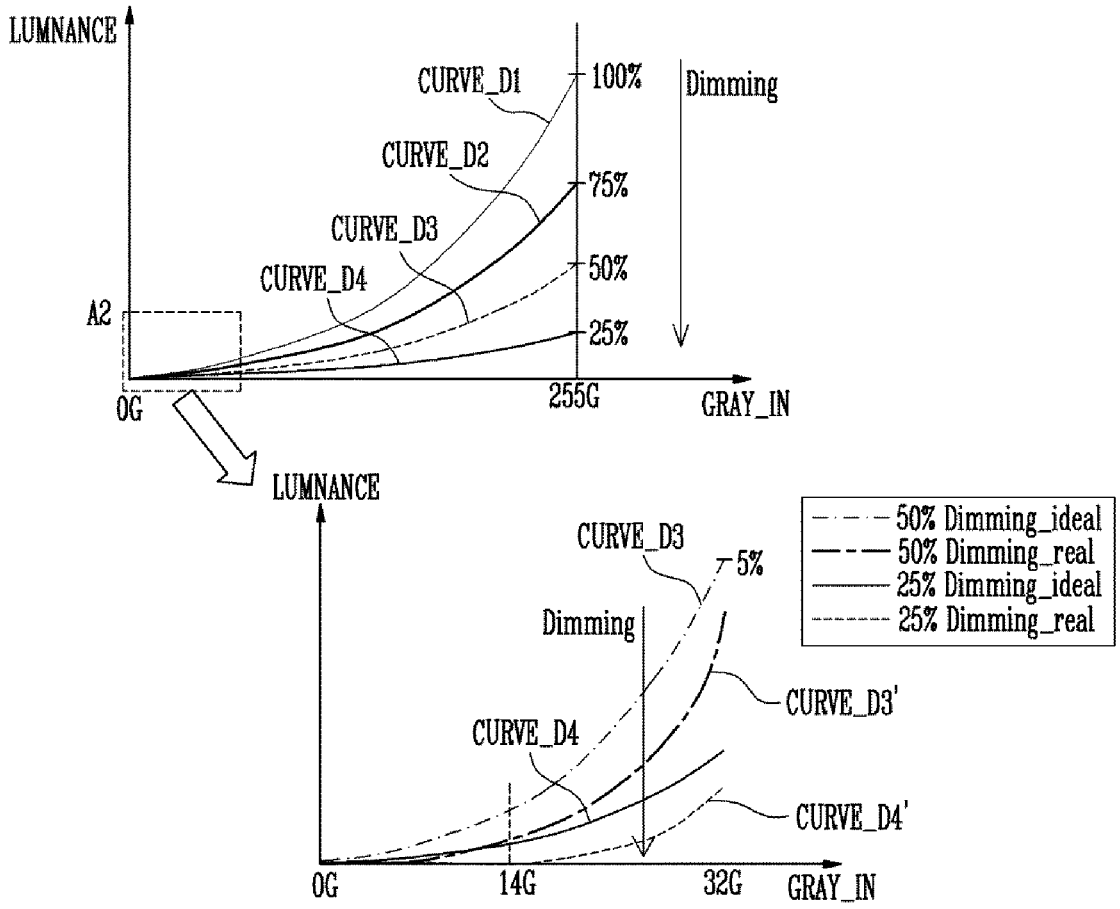
FIG. 4 is a graph illustrating a change in the light emission characteristics of the corresponding pixel attributable to the adjacent pixels of FIG. 3.

A change in the light emission characteristics of the pixels may be explained referring to FIG. 4. FIG. 4 is a graph illustrating a change in the light emission characteristics of the corresponding pixel attributable to the adjacent pixels of FIG. 3.

Referring to FIG. 4, first to fourth curves CURVE_D1, CURVE_D2, CURVE_D3, and CURVE_D4 represent luminance values depending on input grayscale values GRAY Ind. (i.e., grayscale values included in the input image data RGB of FIG. 1). The first to fourth curves CURVE_D1 to CURVE_D4 may correspond to gamma curves for respective dimming levels of a display device 1. The fourth curve CURVE_D4 may correspond to a dimming level lower than that of the first curve CURVE_D1. Here, the dimming level is a value representing the ratio of the maximum display luminance to the maximum luminance of the display device 1 as a percentage, wherein the higher the dimming level, the higher the maximum display luminance.

As in a second area A2 of the curves (i.e., low grayscale range having a grayscale value ranging about from 0 to 32) illustrated in FIG. 4, a third actual curve CURVE_D3' having a dimming level of 50% exhibits luminance lower than that of the third curve CURVE_D3 (i.e., ideal gamma curve). Similarly, a fourth actual curve CURVE_D4' having a dimming level of 25% exhibits luminance lower than that of the fourth curve CURVE_D4. For example, most of grayscale values less than or equal to 14 on the fourth actual curve CURVE_D4' may correspond to a luminance value of 0.

Therefore, the controller 140 may remap input grayscale values GRAY_IN within a partial grayscale range in which the luminance of the input image data RGB does not appear (e.g., the grayscale range of values less than or equal to a grayscale value of 14 in FIG. 4) to grayscale values within a grayscale range in which luminance appears (e.g., grayscale range of values greater than a grayscale value of 14).

Figure 5:
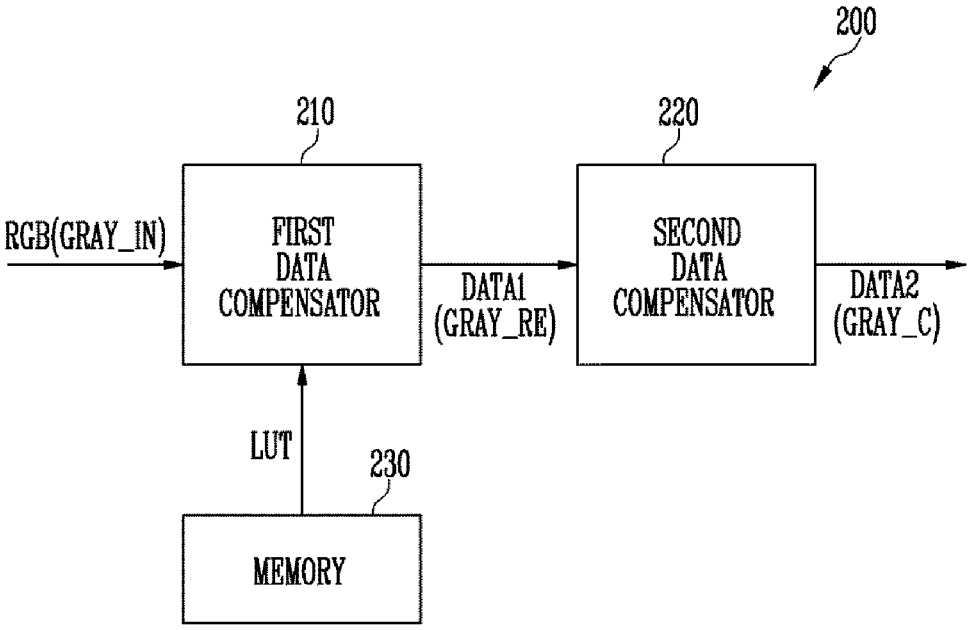
FIG. 5 is a block diagram illustrating an example of a controller in the display device of FIG. 1.

FIG. 5 is a block diagram illustrating an example of a controller included in the display device of FIG. 1. In FIG. 5, the controller 140 is exemplarily illustrated based on a function of remapping and compensating for grayscale values (e.g., data conversion function). Hereinafter, the controller 140 for performing the data conversion function will be referred to as a "data converter 200."

Referring to FIGS. 1 and 5, the data converter 200 may include a first data compensator 210 and a second data compensator 220. The data converter 200 may further include a memory device 230.

The first data compensator 210 (or grayscale remapping unit) may generate a remapped grayscale value GRAY_RE by remapping an input grayscale value GRAY_IN, included in input image data RGB, from a first grayscale range to a second grayscale range. The remapped grayscale value GRAY_RE may be included in first converted data DATA1.

Before remapping the input grayscale value GRAY_IN, the first data compensator 210 may convert the input image data RGB into a data format corresponding to the array of pixels PX in the display unit 110. For example, when the input image data RGB is RGB data and the pixels PX are arranged in the display unit 110 in an RGBG pentile structure, the first data compensator 210 may convert the RGB data into RGBG data corresponding to the pentile pixel structure. In this case, the first data compensator 210 may perform a grayscale remapping operation on the RGBG data.

Figure 6:
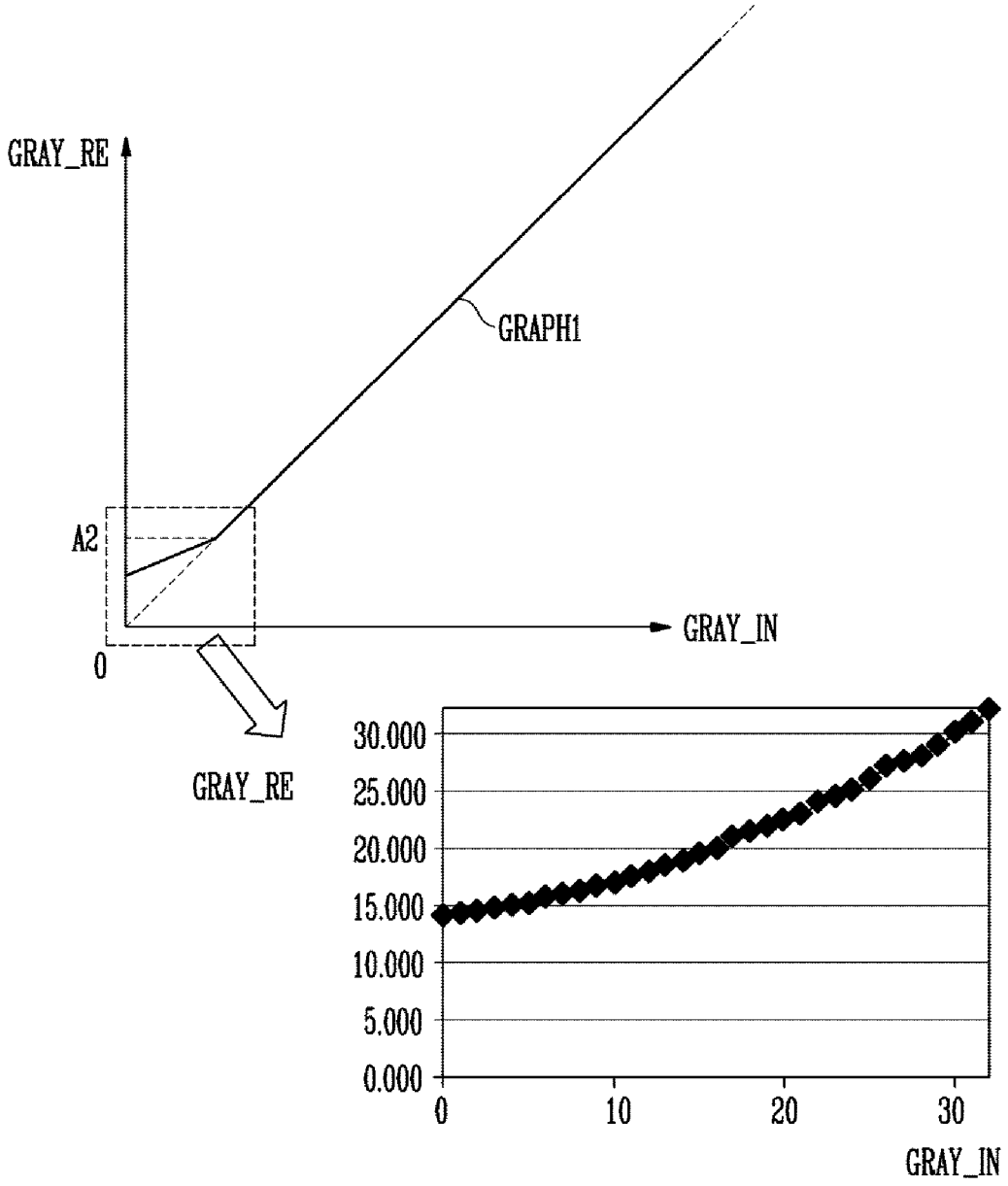
FIG. 6 is a graph for explaining grayscale remapping performed by a first data compensator in the controller of FIG. 5.

The grayscale remapping may be explained referring to FIG. 6. FIG. 6 is a graph for explaining grayscale remapping performed by the first data compensator in the controller of FIG. 5.

Referring to FIG. 6, a first graph GRAPH1 indicates a relationship between an input grayscale value GRAY_IN included in input image data RGB and a remapped grayscale value GRAY_RE (or a first compensated grayscale value).

In exemplary embodiments, the first grayscale range may include a first low grayscale range and a second low grayscale range, which is a part of (or a subset of) the first low grayscale range, and the first data compensator 210 may remap first low grayscale values included in the first low grayscale range to second low grayscale values included in the second low grayscale range.

For example, the first data compensator 210 may remap an input grayscale value GRAY_IN included in the first low grayscale range in which a grayscale value ranges about from 0 to 32, to a remapped grayscale value GRAY_RE included in the second low grayscale range in which the grayscale value ranges about from 14 to 32.

In an exemplary embodiment, the first data compensator 210 may detect a first grayscale value (e.g., a grayscale value of 14) at which luminance starts to appear in a fourth actual curve CURVE_D4', described above with reference to FIG. 4, and may set the first grayscale value as a start grayscale value (i.e., the minimum grayscale value of the second grayscale range or the minimum grayscale value of the second low grayscale range). Also, referring to FIG. 4, the first data compensator 210 may detect and set a second grayscale value at which the fourth actual curve CURVE_D4' and the fourth curve CURVE_D4 (e.g., an ideal gamma 2.2 curve) meet each other as an end grayscale value (i.e., the maximum grayscale value of the second grayscale range or the maximum grayscale value of the second low grayscale range). For example, the first data compensator 210 may remap the input grayscale value GRAY_IN included in the first low grayscale range, in which the grayscale value ranges about from 0 to 32, to the remapped grayscale value GRAY_RE included in the second low grayscale range, in which the grayscale value ranges about from 14 to 32.

That is, the first data compensator 210 may remap the input grayscale value GRAY_IN within the first grayscale range to the remapped grayscale value GRAY_RE within the second grayscale range using the following Equation (1):

$$GRAY_RE=(GRAY_END-GRAY_START)/GRAY_END\times GRAY_START \quad (1)$$

Here, GRAY_END refers to the end grayscale value or the maximum grayscale value of the second grayscale range (or the second low grayscale range), and GRAY_START refers to the start grayscale value or the minimum grayscale value of the second grayscale range (or the second low grayscale range).

In exemplary embodiments, the first data compensator 210 may remap the input grayscale value GRAY_IN to the remapped grayscale value GRAY_RE using a lookup table LUT. Here, the lookup table LUT may include mapping information between the input grayscale value GRAY_IN and the remapped grayscale value GRAY_RE, and may be stored in a memory device 230.

The lookup table LUT may be explained referring to FIG. 7. FIG. 7 is a diagram illustrating an example of a lookup table LUT that may be used in the first data compensator in the controller of FIG. 5.

Referring to FIG. 7, the lookup table LUT may include remapped grayscale values GRAY_RE ranging about from 14 to 32 corresponding to input grayscale values GRAY_IN ranging about from 0 to 32.

For example, an input grayscale value GRAY_IN of 0 may correspond to a remapped grayscale value GRAY_RE of 14. As the input grayscale value GRAY_IN is increased by a grayscale value of 1, the remapped grayscale value GRAY_RE may be increased by a grayscale value of 0.25 or 0.5 less than 1.

Referring back to FIG. 5, the second data compensator 220 may generate a compensated grayscale value GRAY_C (or a second compensated grayscale value) by compensating for the remapped grayscale value GRAY_RE based on adjacent grayscale values. The compensated grayscale value GRAY_C may be included in second conversion data DATA2 (or DATA, see FIG. 1).

Figure 8:
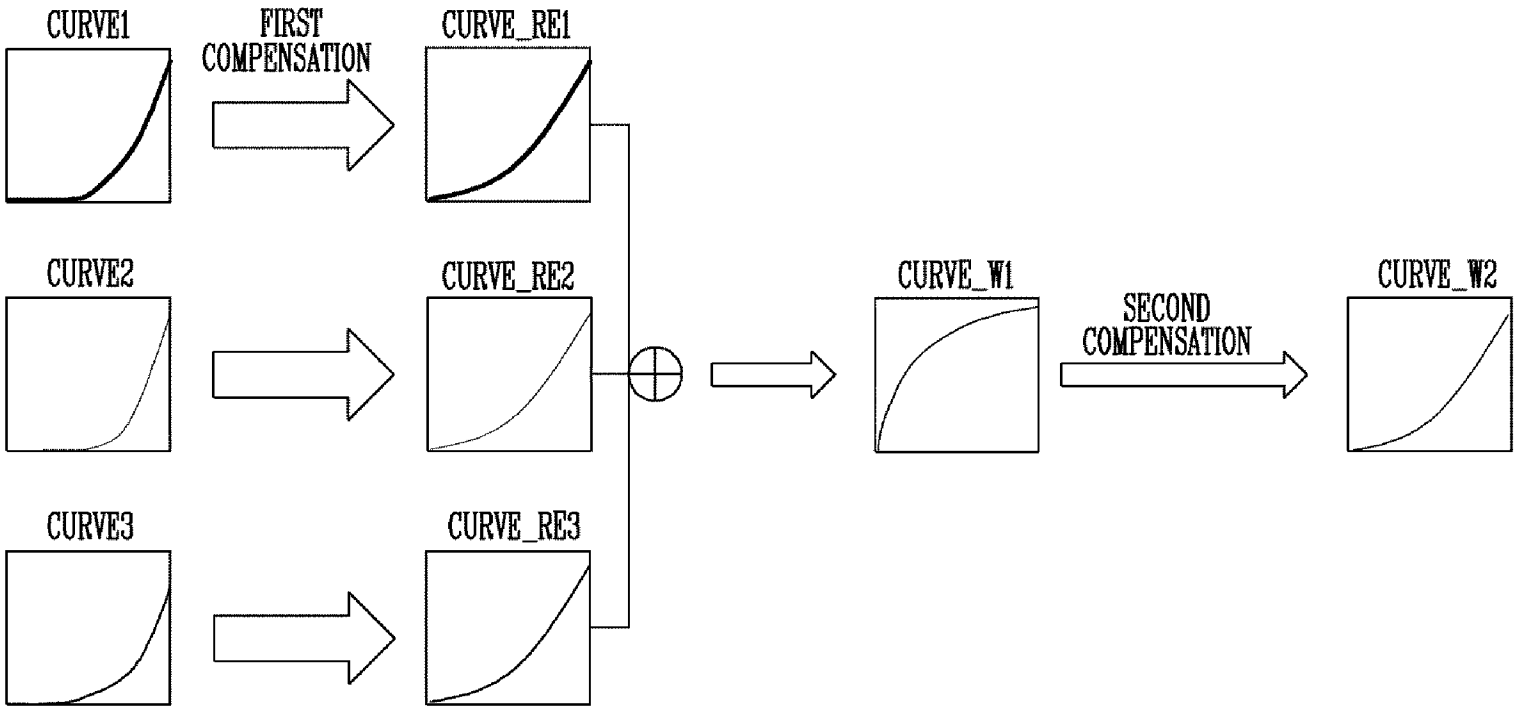
FIG. 8 is a conceptual diagram illustrating a change in a gamma curve by the controller of FIG. 5.

The generation of the second conversion data DATA2 may be explained by referring to FIG. 8. FIG. 8 is a conceptual diagram illustrating a change in a gamma curve by the controller of FIG. 5.

Referring to FIGS. 3 and 8, light emission characteristics (or gamma characteristics) of respective pixels PX1 to PX3 illustrated in FIG. 3 may be adjusted to match reference gamma characteristics (e.g., an ideal gamma 2.2 curve) by performing grayscale remapping for respective pixels PX1 to PX3.

As illustrated in FIG. 8, a first gamma curve CURVE1 indicating the light emission characteristics of the first pixel PX1 may be converted into a first compensated gamma curve CURVE_RE1 having the same shape as the reference gamma curve through grayscale remapping (or a first compensation operation). Similarly, a second gamma curve CURVE2 indicating the light emission characteristics of the second pixel PX2 may be converted into a second compensated gamma curve CURVE_RE2 having the same shape as the reference gamma curve. A third gamma curve CURVE3 indicating the light emission characteristics of the third pixel PX3 may be converted into a third compensated gamma curve CURVE_RE3 having the same shape as the reference gamma curve.

However, when the first to third compensated gamma curves CURVE_RE1, CURVE_RE2, and CURVE_RE3 are merged into a single white gamma curve CURVE_W1, the white gamma curve CURVE_W1 (or white balance of the first to third pixels PX1, PX2, and PX3) may be distorted, and may then have a shape different from those of the first to third compensated gamma curves CURVE_RE1, CURVE_RE2, and CURVE_RE3, that is, different gamma characteristics.

The reason for this is that, when the first to third pixels PX1, PX2, and PX3 simultaneously emit light, lateral leakage occurring in each of the first to third pixels PX1, PX2, and PX3 is decreased.

Therefore, the second data compensator 220 of FIG. 5 may readjust the white gamma curve CURVE_W1 to a corrected white gamma curve CURVE_W2 by performing second compensation on the white gamma curve CURVE_W1. Here, the corrected white gamma curve CURVE_W2 may match the reference gamma curve.

In exemplary embodiments, the second data compensator 220 may correct the remapped grayscale value GRAY_RE of the target pixel to the compensated grayscale value GRAY_C using the following Equation (2):

$$\mathrm{GRAY}ij' = \mathrm{GRAY}ij - G \times D(a1 \times \mathrm{GRAY}i-1j-1 + a2 \times \mathrm{GRAY}i-1j + a3 \times \mathrm{GRAY}i-1j+1 + a4 \times \mathrm{GRAY}ij-1 + a5 \times \mathrm{GRAY}ij+1 + a6 \times \mathrm{GRAY}i+1j-1 + a7 \times \mathrm{GRAY}i+1j + a8 \times \mathrm{GRAY}i+1j+1) \quad (2)$$

Here, GRAYij may be a remapped grayscale value GRAY_RE corresponding to a pixel located in an i-th row and a j-th column, and GRAYij' may be a compensated grayscale value GRAY_C for GRAYij. Here, a1, a2, a3, a4, a5, a6, a7, and a8 may be respective compensation coefficients of adjacent grayscale values, G may be a first gain, and D may be a second gain. As will be described later, the first gain G may be decreased as the remapped grayscale value GRAY_RE of the target pixel is increased, and may be, for example, a value between 0 and 1. Similarly, the second gain D may be decreased as the dimming level of the display device 1 is increased, and may be, for example, a value between 0 and 1.

For example, a compensated grayscale value GRAY_C of a pixel located in a second row and a second column, that is, GRAY22', may be corrected to or calculated as "GRAY22−G*D*(a1*GRAY11+a2*GRAY12+a3*GRAY13+a4*GRAY21+a5*GRAY23+a6*GRAY31+a7*GRAY32+a8*GRAY33)".

When the compensated grayscale value GRAY_C, which is calculated using Equation (2), has a negative (−) value, the second data compensator 220 may replace the compensated grayscale value GRAY_C with 0 or may truncate the compensated grayscale value GRAY_C.

By means of Equation (2), the second data compensator 220 may generate the compensated grayscale value GRAY_C by decreasing the remapped grayscale value GRAY_RE of the target pixel in response to one of the adjacent grayscale values being increased.

In exemplary embodiments, the second data compensator 220 may calculate a first compensation value for the target pixel based on the adjacent grayscale values, and may calculate the compensated grayscale value GRAY_C of the target pixel by subtracting the first compensation value from the remapped grayscale value GRAY_RE of the target pixel.

In an exemplary embodiment, the second data compensator 220 may calculate the first compensation value by computing a weighted sum of the adjacent grayscale values using respective preset compensation coefficients a1 to a8 as weights in accordance with the adjacent grayscale values. Here, the compensation coefficients a1 to a8 may be included in a compensation filter.

The compensation filter may be explained by referring to FIGS. 9A and 9B. FIG. 9A is a diagram illustrating an example of a compensation filter used in the second data compensator in the controller of FIG. 5. FIG. 9B is a diagram illustrating embodiments of the compensation filter of FIG. 9A.

First, referring to FIG. 9A, a compensation filter FILTER1 may have a size of 3 rows*3 columns, and may include first to eighth compensation coefficients a1, a2, a3, a4, a5, a6, a7, and a8 and a reference compensation coefficient a0. The reference compensation coefficient a0 may be a coefficient to be applied to a remapped grayscale value GRAY_RE corresponding to a target pixel, and may be, for example, 0.

In exemplary embodiments, the first to eighth compensation coefficients a1, a2, a3, a4, a5, a6, a7, and a8 may each be a constant between 0.01 and 0.15, and the total sum of the first to eighth compensation coefficients a1 to a8 may be less than 0.5.

In an exemplary embodiment, first compensation coefficients for first adjacent pixels included in the same row as the target pixel, among the adjacent pixels, may be different from second compensation coefficients for second adjacent pixels included in the same column as the target pixel, among the adjacent pixels. For example, the first compensation coefficients may be greater than the second compensation coefficients.

Referring to FIG. 9B, a first compensation filter FILTER_S1 and a second compensation filter FILTER_S2 are exemplarily illustrated.

In the first compensation filter FILTER_S1, the first compensation coefficients for the first adjacent pixels included in the same row as the target pixel, that is, the fourth compensation coefficient a4 and the fifth compensation coefficient a5, illustrated in FIG. 9A, are 0.125. The second compensation coefficients for the second adjacent pixels included in the same column as the target pixel, that is, the second compensation coefficient a2 and the seventh compensation coefficient a7, illustrated in FIG. 9A, are 0.1. Here, the fourth compensation coefficient a4 and the fifth compensation coefficient a5 may be greater than the second compensation coefficient a2 and the seventh compensation coefficient a7.

The reason for this is that, by means of the gate driver 130, described above with reference to in FIG. 1, the display unit 110 (or pixels PX) displays an image in a sequential driving manner, and thus the influence of lateral leakage caused by the adjacent pixels which are included in the same row to simultaneously emit light, may be more exerted on the target pixel than the adjacent pixels which are included in the same column to sequentially emit light.

The first compensation coefficient a1, the third compensation coefficient a3, the sixth compensation coefficient a6, and the eighth compensation coefficient a8 for adjacent pixels arranged in a diagonal direction with respect to the target pixel are 0.05 may be much smaller than the remaining compensation coefficients a2, a4, a5, and a7. The reason for this is that the adjacent pixels arranged in a diagonal direction with respect to the target pixel depending on the structure of a pixel array are relatively spaced apart from the target pixel, and thus the influence of the lateral leakage may be less exerted on the target pixel.

Similarly, in the second compensation filter FILTER_S2, the first compensation coefficients for first adjacent pixels included in the same row as the target pixel, that is, the fourth compensation coefficient a4 and the fifth compensation coefficient a5, illustrated in FIG. 9A, may be the largest value, that is, 0.1. The second compensation coefficients for the second adjacent pixels included in the same column as the target pixel, that is, the second compensation coefficient a2 and the seventh compensation coefficient a7, illustrated in FIG. 9A, may be 0.05. Here, the first compensation coefficient a1, the third compensation coefficient a3, the sixth compensation coefficient a6, and the eighth compensation coefficient a8 may be the smallest value, that is, 0.025.

In exemplary embodiments, the second data compensator 220 may continuously calculate the first compensation value in the compensation filter or the compensated grayscale value GRAY_C while moving the compensation filter (e.g., the first compensation filter FILTER_S1 or the second compensation filter FILTER_S2) on a pixel basis.

Figure 10:
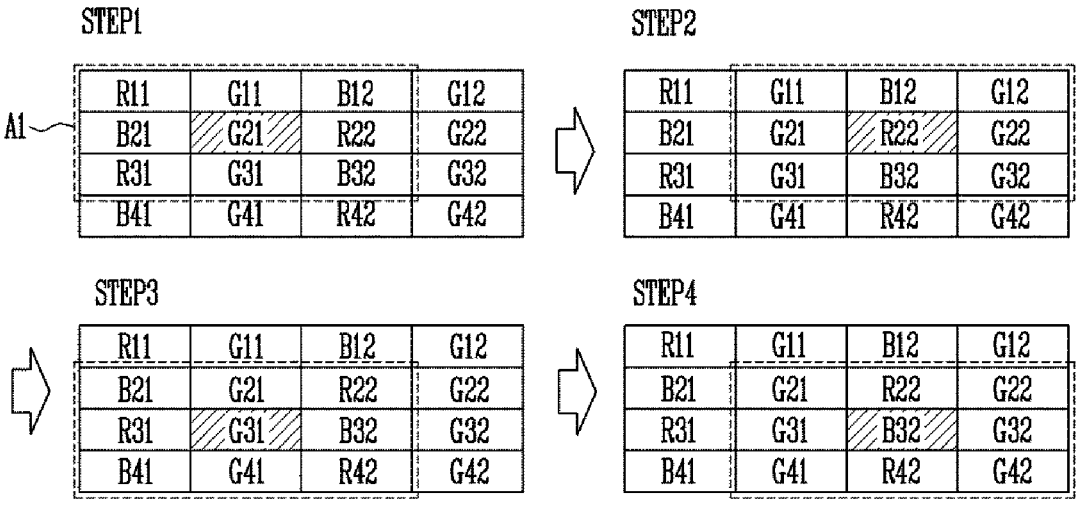
FIG. 10 is a diagram illustrating an example of a process in which the controller of FIG. 5 compensates for a grayscale value using the compensation filter of FIG. 9A.

A procedure for calculating the compensated grayscale value GRAY_C of the second data compensator 220 may be explained referring to FIG. 10. FIG. 10 is a diagram illustrating an example of a process in which the controller of FIG. 5 compensates for a grayscale value using the compensation filter of FIG. 9A.

Referring to FIGS. 1, 9A, and 10, pixels in a first area A1 of FIG. 1 are exemplarily illustrated, wherein the pixels may be arranged in an RGBG pentile structure.

At first step STEP1, the second data compensator 220 may arrange a compensation filter FILTER1 in accordance with a 21-st green pixel G21, compute a weighted sum of grayscale values corresponding to an 11-th red pixel R11, an 11-th green pixel G11, a 12-th blue pixel B12, a 21-st blue pixel B21, a 22-th red pixel R22, a 31-st red pixel R31, a 31-th green pixel G31, and a 32-th blue pixel B32 in the compensation filter FILTER1, and then calculate a compensation value or a compensated grayscale value GRAY_C corresponding to the 21-st green pixel G21.

For reference, the second data compensator 220 may calculate the compensation value or the compensated grayscale value GRAY_C in consideration of only the array of the pixels without considering the emission color of the pixels. Accordingly, the grayscale value of at least one pixel (e.g., the 11-th red pixel R11, the 12-th blue pixel B12, or the like) which emits light in a color different from that of the target pixel (e.g., the 21-th green pixel G21) may be used to calculate the compensation value or the second compensated grayscale value of the target pixel.

Similarly, at second step STEP2, the second data compensator 220 may move or arrange the compensation filter FILTER1 in accordance with the 22-th red pixel R22, compute a weighted sum of grayscale values corresponding to adjacent pixels in the compensation filter FILTER1, and then calculate the compensation value or the second compensated grayscale value corresponding to the 22-th red pixel R22.

When the calculation of the compensation value or the second compensated grayscale value for one row is completed, the second data compensator 220 may arrange the compensation filter FILTER1 in accordance with the 31-st green pixel G31 in a next row and then calculate a compensation value or a second compensated grayscale value corresponding to the 31-st green pixel G31, at third step STEP3.

Thereafter, at fourth step STEP4, the second data compensator 220 may repeatedly perform the calculation of the compensation value or the second compensated grayscale value while moving the compensation filter FILTER1 in a row direction (or a horizontal direction) on a pixel basis.

In exemplary embodiments, the second data compensator 220 may calculate the compensation value or the compensated grayscale value GRAY_C by selectively applying a plurality of compensation filters.

Figure 11:
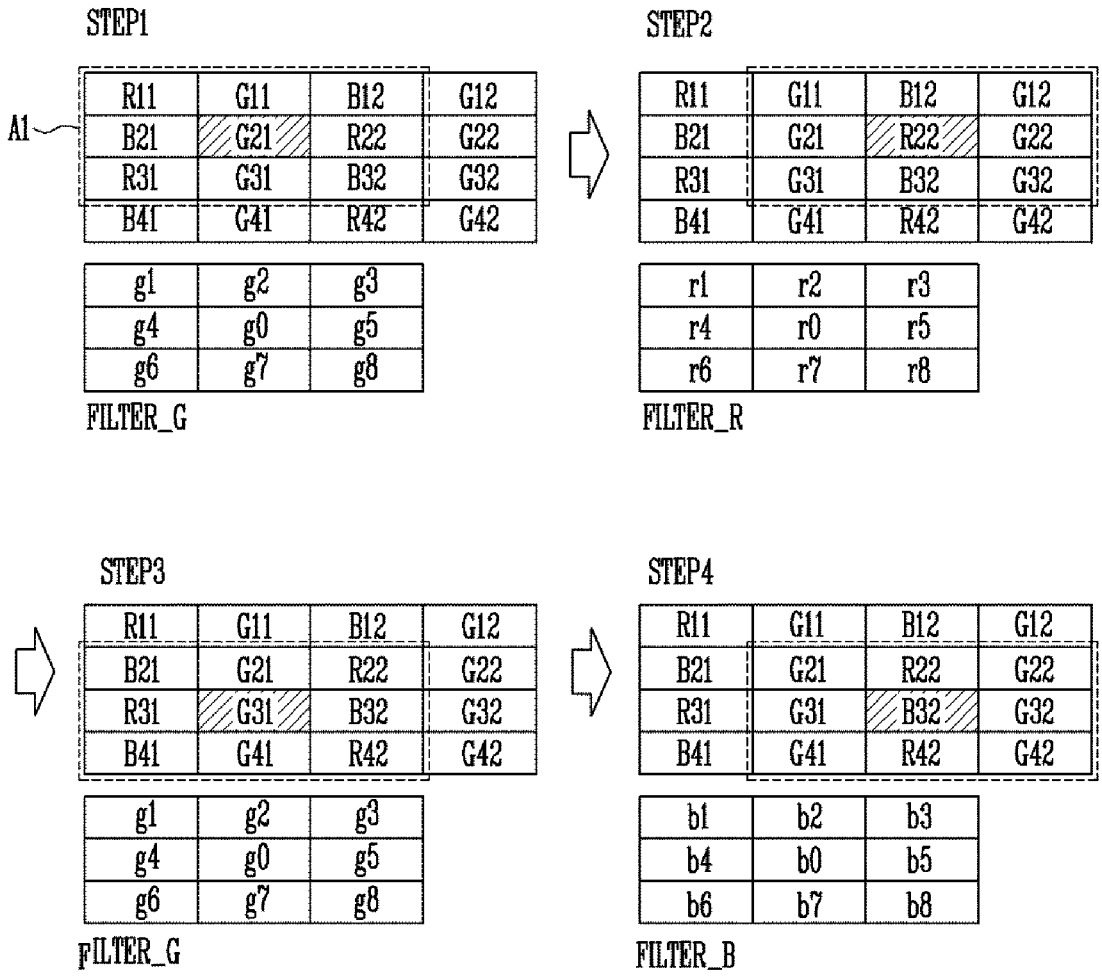
FIG. 11 is a diagram illustrating an example of a process in which the controller of FIG. 5 compensates for a grayscale value using the compensation filter of FIG. 9A.

A configuration of selectively applying the compensation filters may be explained referring to FIG. 11. FIG. 11 is a diagram illustrating an example of a process in which the controller of FIG. 5 compensates for a grayscale value using the compensation filter of FIG. 9A.

Referring to FIGS. 10 and 11, at first to fourth steps STEP1 to STEP4, the operation of the second data compensator 220 is different from that of the second data compensator 220 of FIG. 10 in that a green filter FILTER_G, a red filter FILTER_R, and a blue filter FILTER_B, set for respective types of pixels (or respective emission colors), are selectively applied. For example, the green filter FILTER_G may be the first compensation filter FILTER_S1 illustrated in FIG. 9B, and the red filter FILTER_R and the blue filter FILTER_B may each be the second compensation filter FILTER_S2 illustrated in FIG. 9B, but the application of the compensation filters is not limited thereto.

As illustrated in FIG. 11, at first step STEP1, the second data compensator 220 may apply the green filter FILTER_G to the 21-st green pixel G21. At second step STEP2, the second data compensator 220 may apply the red filter FILTER_R to the 22-th red pixel R22. At third step STEP3, the second data compensator 220 may apply the green filter FILTER_G to the 31-st green pixel G31. At fourth step STEP4, the second data compensator 220 may apply the blue filter FILTER_B to the 32-th blue pixel B32.

That is, the second data compensator 220 may calculate the compensation value or the compensated grayscale value GRAY_C by selectively applying one of different filters (e.g., the green filter FILTER_G, the red filter FILTER_R, and the blue filter FILTER_B) to each adjacent pixel.

In exemplary embodiments, a first gain G used in Equation (2) may be set based on the first compensated grayscale value of the target pixel, may be decreased as the first compensated grayscale value is increased, and may have a value ranging about from 0 to 1.

Figure 12:
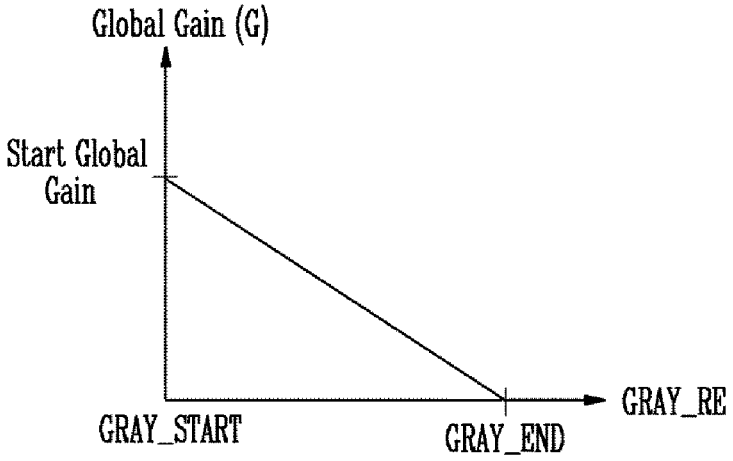
FIG. 12 is a graph illustrating an example of a first gain used in the controller of FIG. 5.

The first gain G may be explained referring to FIG. 12. FIG. 12 is a graph illustrating an example of the first gain used in the controller of FIG. 5.

Referring to FIG. 12, the first gain G (or a global gain) may have a maximum value (e.g., 1) when a remapped grayscale value GRAY_RE is equal to the start grayscale value GRAY_START of a second grayscale range, and may have a minimum value (e.g., 0) when the remapped grayscale value GRAY_RE is equal to the end grayscale value GRAY_END of the second grayscale range.

Referring to FIG. 6 as an example, when the remapped grayscale value GRAY_RE is 14, the first gain G may have a value of 1, and when the remapped grayscale value GRAY_RE is 32, the first gain G may have a value of 0.

When the remapped grayscale value GRAY_RE is increased within the second grayscale range, the first gain G is linearly decreased. When the remapped grayscale value GRAY_RE is greater than the end grayscale value GRAY_END of the second grayscale range, the first gain G may have the minimum value, for example, a value of 0.

As described above with reference to FIGS. 3 and 4, the remapped grayscale value GRAY_RE is decreased, lateral leakage to the target pixel may be increased, and the influence of the adjacent pixels may also be increased. Therefore, in Equation (2), the compensation value (i.e., a weighted sum of adjacent grayscale values corresponding to adjacent pixels) is in inversely proportional to the remapped grayscale value GRAY_RE. As the remapped grayscale value GRAY_RE of the target pixel is smaller, the influence of the adjacent grayscale values may be more exerted on the target pixel.

In exemplary embodiments, a second gain D used in Equation (2) may be set based on the dimming level of the display device 1, may be decreased as the dimming level becomes higher, and may have a value ranging from 0 to 1.

Figure 13:
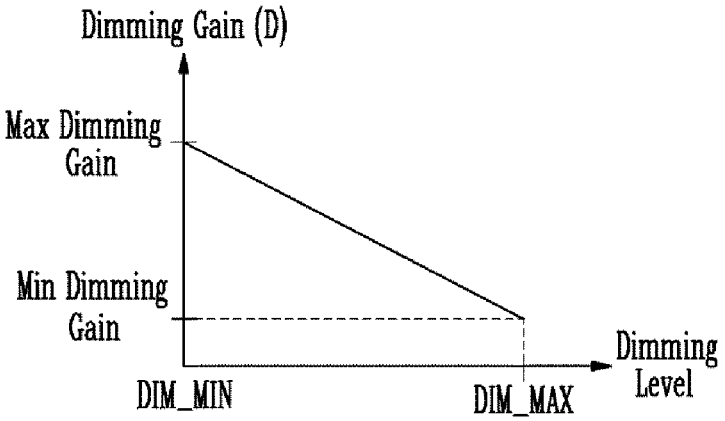
FIG. 13 is a graph illustrating an example of a second gain used in the controller of FIG. 5.

The second gain D may be explained referring to FIG. 13. FIG. 13 is a graph illustrating an example of the second gain used in the controller of FIG. 5.

Referring to FIG. 13, the second gain D (or dimming gain) may have a maximum value (Max Dimming Gain, e.g., 1) at a minimum dimming level DIM MIN, may have a minimum value (Min Dimming Gain, e.g., 0) at a maximum dimming level DIM MAX, and may be linearly decreased as the dimming level is increased. Referring to FIG. 4 as an example, when the dimming level is 25%, the second gain D may have a value of 1, and when the dimming level is 100%, the second gain D may have a value of 0.1.

The reason for this is that, as described above with reference to FIGS. 3 and 4, as the dimming level becomes lower, all of the first compensated grayscale values may become smaller, and thus lateral leakage to the target pixel may be relatively increased, and the influence of adjacent pixels may be increased.

Therefore, in Equation (2), the compensation value (i.e., a weighted sum of the adjacent grayscale values corresponding to adjacent pixels) is in inversely proportional to the dimming level. As the dimming level becomes lower, the influence of the adjacent grayscale values may be more exerted on the target pixel.

As described above with reference to FIGS. 5, 6, 7, 8, 9A, 9B, 10, 11, 12, and 13, the data converter 200 (or the controller 140) may correct gamma characteristics of respective pixels so that the gamma characteristics match reference gamma characteristics in a low grayscale range (or low current region or a low luminance region) through grayscale remapping. Also, the data converter 200 may correct white gamma characteristics (or white balance) caused by the pixels so that the white gamma characteristics match the reference gamma characteristics through grayscale compensation using adjacent grayscale values. Therefore, the deterioration of the display quality of the display device 1 may be prevented or reduced.

Meanwhile, in FIGS. 5 and 13, an example has been described in which the second data compensator 220 compensates for the remapped grayscale value GRAY_RE based on the remapped grayscale value GRAY_RE and adjacent grayscale values (or the remapped grayscale values of the adjacent pixels) and generates the compensated grayscale value GRAY_C, but the present disclosure is not limited thereto.

In embodiments, the second data compensator 220 may compensate for the input grayscale value GRAY_IN based on the remapped grayscale value GRAY_RE and the adjacent grayscale values (or the remapped grayscale values of the adjacent pixels), and may then generate the compensated grayscale value GRAY_C (or the second compensated grayscale value).

In an embodiment, the second data compensator 220 may correct the input grayscale value GRAY_IN of the target pixel to the compensated grayscale value GRAY_C using the following Equation (3).

$$(1)\ \mathrm{GRAY}ij'=\mathrm{GRAY_IN}ij+F(\Delta ij-LLF(i,j))$$

$$(\mathrm{but},F(X)=x(x>0),0(x<0))$$

$$(2)\ \Delta ij=\mathrm{GRAY}ij-\mathrm{GRAY_IN}ij$$

$$(3)\ LLF(i,j)=G\times D\times(a1\times\mathrm{GRAY}i-1j-1+a2\times\mathrm{GRAY}i-1j+a3\times\mathrm{GRAY}i-1j+1+a4\times\mathrm{GRAY}ij-1+a0\times\mathrm{GRAY}ij+a5\times\mathrm{GRAY}ij+1+a6\times\mathrm{GRAY}i+1j-1+a7\times\mathrm{GRAY}i+1j+a8\times\mathrm{GRAY}i+1j+1) \quad (3)$$

Here, GRAY_INij may be the input grayscale value GRAY_IN corresponding to a pixel located in an i-th row and a j-th column, GRAYij may be the remapped grayscale value GRAY_RE for the input grayscale value GRAY_IN, and GRAYij' may be the compensated grayscale value GRAY_C for the input grayscale value GRAY_IN. Δij may be a difference value between the remapped grayscale value GRAY_RE and the input grayscale value GRAY_IN. a0 may be a reference compensation coefficient for the input grayscale value GRAY_IN, a1 to a8 may be respective compensation coefficients of the adjacent grayscale values, G may be a first gain, and D may be a second gain. As will be described later, the first gain G may be decreased as the remapped grayscale value GRAY_RE of the target pixel is increased, and may be, for example, a value between 0 and 1. Similarly, the second gain D may be decreased as the dimming level of the display device 1 is increased, and may be, for example, a value between 0 and 1. F(x) may be a limit function for x.

For example, a compensated grayscale value GRAY_C of a pixel located in a is second row and a second column, that is, GRAY22', may be calculated as "GRAY_IN22+F(GRAY22−GRAY_IN22)−G*D*(a1*GRAY11+a2*GRAY12+a3*GRAY13+a4*GRAY21+a5*GRAY23+a6*GRAY31+a7*GRAY32+a8*GRAY33))".

Meanwhile, depending on circumstances, the input grayscale value GRAY_IN of the target pixel may be remapped to grayscale values lower than the input grayscale value GRAY_IN. Accordingly, Equation (3) may be generalized and represented by the following Equation (4):

$$\text{GRAY}ij' = \text{GRAY_IN}ij + (\text{sign of } \Delta ij) \times (F(|\Delta ij| - LLF(i, j))$$

$$(\text{but, } F(x) = x(x>0), o<0), \text{ and}$$

$$\text{sign of } \Delta ij = 1(\Delta ij>0), -1(\Delta ij<0)) \quad (4)$$

Here, sign of Δij may be the sign of the difference value, and |Δij| may be the absolute value of Δij.

Figure 14:
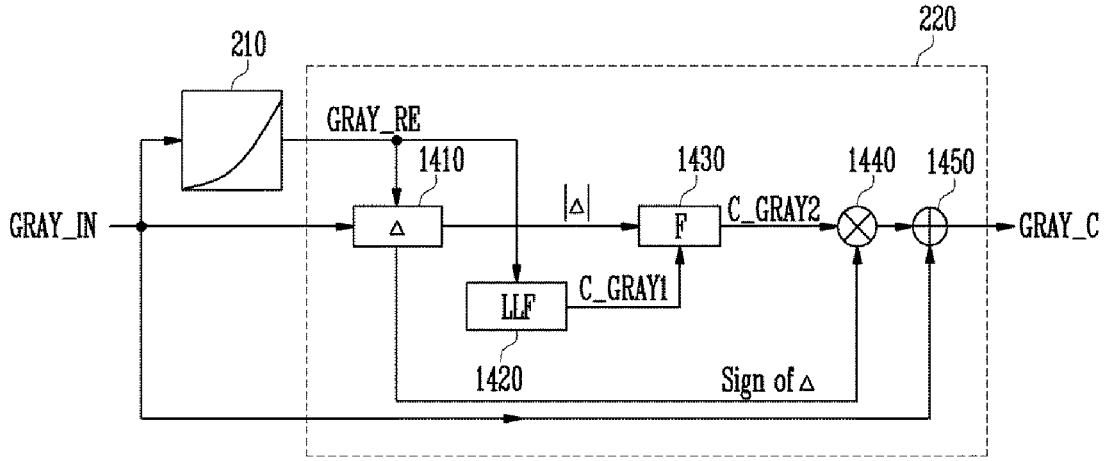
FIG. 14 is a block diagram illustrating an example of a second data compensator included in the controller of FIG. 5.

The second data compensator 220 which compensates for the input grayscale value GRAY_IN based on Equation (4) may be implemented as a logic circuit based on the block diagram of FIG. 14.

FIG. 14 is a block diagram illustrating an example of the second data compensator included in the controller of FIG. 5.

Referring to FIG. 14, the second data compensator 220 may include a first operation circuit 1410 (or a first logical operation circuit), a second operation circuit 1420, a third operation circuit 1430, a fourth operation circuit 1440, and a fifth operation circuit 1450.

The first operation circuit 1410 may calculate a difference value Δ by subtracting is the input grayscale value GRAY_IN of the target pixel from the remapped grayscale value GRAY_RE of the target pixel generated by the first data compensator 210.

The second operation circuit 1420 may calculate a first compensation value C_GRAY1 for the target pixel based on adjacent grayscale values. For example, the second operation circuit 1420 may calculate the first compensation value C_GRAY1 using a compensation filter (or a lateral leakage filter: LLF), and a description thereof will be made later with reference to FIG. 10.

The third operation circuit 1430 may calculate a second compensation value C_GRAY2 by subtracting the first compensation value C_GRAY1 from the absolute value |Δ| of the difference value.

The fourth operation circuit 1440 may set the sign of the second compensation value C_GRAY2 by multiplying the sign of the difference value (i.e., sign of Δ) by the second compensation value C_GRAY2.

The fifth operation circuit 1450 may calculate a compensated grayscale value GRAY_C by adding the input grayscale value GRAY_IN to the second compensation value C_GRAY2. For reference, when the compensated grayscale value is generated by compensating for the remapped grayscale value GRAY_RE, the compensated grayscale value may be lower than the input grayscale value GRAY_IN, and thus the second data compensator 220 may compensate for the input grayscale value GRAY_IN instead of the remapped grayscale value GRAY_RE.

Meanwhile, although the second data compensator 220 has been described as calculating the compensated grayscale value GRAY_C using Equation (4) (or Equation (3)) in FIG. 14, the present disclosure is not limited thereto.

In embodiments, the second data compensator 220 may correct the input grayscale value GRAY_IN of the target pixel to the compensated grayscale value GRAY_C using the following Equation (5).

$$(1)\ \text{GRAY}ij' = \text{GRAY_IN}ij + F(\Delta ij - LLF(i,j)) \times \text{GAIN}$$

$$(2)\ \Delta ij = \text{GRAY}ij - \text{GRAY_IN}ij$$

$$(3)\ LLF(i,j) = G \times D \times (a1 \times \text{GRAY}i-1j-1 + a2 \times \text{GRAY}i-1j + a3 \times \text{GRAY}i-1j+1 + a4 \times \text{GRAY}ij-1 + a0 \times \text{GRAY}ij + a5 \times \text{GRAY}ij+1 + a6 \times \text{GRAY}i+1j-1 + a7 \times \text{GRAY}i+1j + a8 \times \text{GRAY}i+1j+1) + a(\text{but}, a \neq 0)$$

$$(4)\ \text{GAIN} = \text{GRAY_IN}ij / LLF(i,j) \quad (5)$$

The compensated grayscale value GRAY_C (i.e., GRAYij') based on Equation (5) may be different from the compensated grayscale value based on Equation (2) in that GRAYij' is calculated in consideration of the gain.

Figure 15:
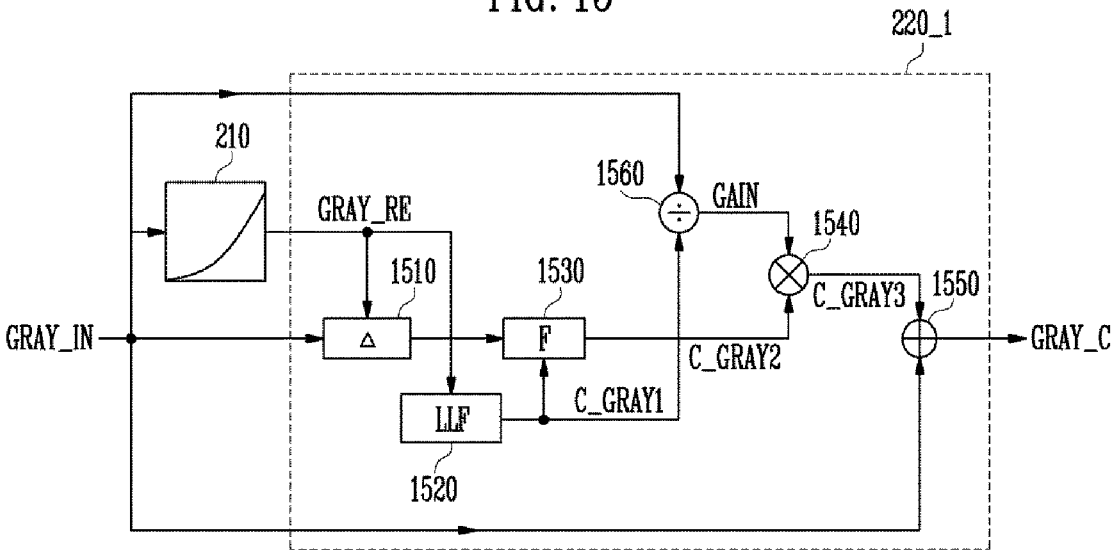
FIG. 15 is a block diagram illustrating an example of the second data compensator included in the controller of FIG. 5.

The second data compensator 220 which compensates for the input grayscale value GRAY_IN based on Equation (5) may be implemented as the logic circuit based on the block diagram of FIG. 15.

FIG. 15 is a block diagram illustrating an example of the second data compensator included in the controller of FIG. 5.

Referring to FIGS. 14 and 15, a second data compensator 220_1 of FIG. 15 may include a first operation circuit 1510 (or a first logical operation circuit), a second operation circuit 1520, a third operation circuit 1530, a fourth operation circuit 1540, a fifth operation circuit 1550, and a sixth operation circuit 1560. Since the first operation circuit 1510, the second operation circuit 1520, the third operation circuit 1530, the fourth operation circuit 1540, and the fifth operation circuit 1550 are substantially identical or similar to the first operation circuit 1410 (or the first logical operation circuit), the second operation circuit 1420, the third operation circuit 1430, the fourth operation circuit 1440, and the fifth operation circuit 1450, which are described above with reference to FIG. 14, repeated descriptions thereof will be omitted.

The third operation circuit 1530 may calculate a second compensation value C_GRAY2 by subtracting the first compensation value C_GRAY1 from the difference value A.

The sixth operation circuit 1560 may calculate a gain by dividing the input grayscale value GRAY_IN by the first compensation value C_GRAY1.

The fourth operation circuit 1540 may calculate a third compensation value C_GRAY3 by multiplying the second compensation value C_GRAY2 by the gain.

The fifth operation circuit 1550 may calculate the compensated grayscale value GRAY_C by adding the input grayscale value GRAY_IN to the third compensation value C_GRAY3.

In order to describe effects acquired by the second data compensator 220_1 of FIG. 15, FIGS. 16A and 16B may be referred to below.

Figure 16A:
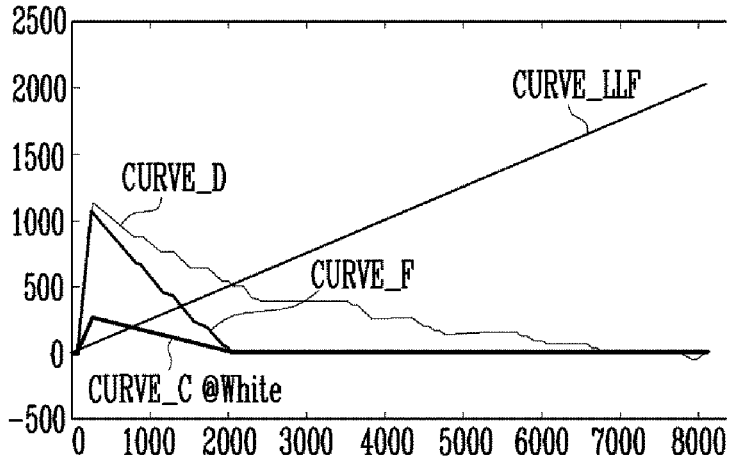
FIG. 16A is a diagram illustrating compensation values calculated for a white image by the second data compensator of FIG. 15.
Figure 16B:
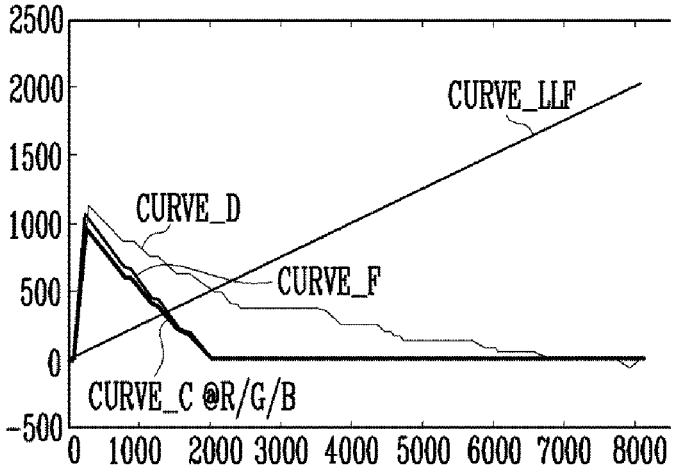
FIG. 16B is a diagram illustrating compensation values calculated for a monochrome image by the second data compensator of FIG. 15.

FIG. 16A is a diagram illustrating compensation values calculated for a white image by the second data compensator of FIG. 15, and FIG. 16B is a diagram illustrating compensation values calculated for a monochrome image by the second data compensator of FIG. 15.

Referring to FIGS. 15, 16A, and 16B, a difference value graph CURVE_D indicates the difference value Δ between grayscale values (i.e., the difference between a remapped grayscale value and an input grayscale value), a first compensation value graph CURVE_LLF indicates a first compensation value C_GRAY1 depending on the grayscale values (i.e., a compensation value calculated by applying a compensation filter), and a second compensation value graph CURVE_F indicates a second compensation value C_GRAY2 depending on the grayscale values (i.e., the result of applying a limit function to the difference between the difference value Δ and the first compensation value C_GRAY1). A third compensation value graph CURVE_C indicates a third compensation value C_GRAY3 (i.e., a value obtained by multiplying the gain by the second compensation value C_GRAY2). Here, the third compensation value graph CURVE_C illustrated in FIG. 16A represents a third compensation value C_GRAY3 for a white image, and the third compensation value graph CURVE_C illustrated in FIG. 16B represents a third compensation value C_GRAY3 for a monochrome image.

When the second data compensator 220_1 uses Equation (4) or Equation (2), described above with reference to FIG. 9, the compensated grayscale value GRAY_C may be calculated by adding the second compensation value C_GRAY2 to the input grayscale value GRAY_IN.

As described above with reference to FIG. 3, although lateral leakage caused by a white image does not occur at a great level, the second compensation value C_GRAY2 may have a relatively large value, as illustrated in FIG. 16A, thus overcompensating for the input grayscale value GRAY_IN.

The second data compensator 220_1 according to an embodiment of the present disclosure may calculate the compensated grayscale value GRAY_C by adding the third compensation value C_GRAY3, in which the gain is reflected, to the input grayscale value GRAY_IN using Equation (4), described above with reference to FIG. 15. Since the gain (i.e., the ratio of the input grayscale value to the first compensation value C_GRAY1) has a relatively small value with respect to the white image (compared to other images), the third compensation value C_GRAY3 may have a relatively small value, as illustrated in FIG. 16A, and thus overcompensation for the input grayscale value GRAY_IN may be prevented.

Meanwhile, lateral leakage depending on a monochrome image may occur at a relatively large level. In this case, since the gain (i.e., the ratio of the input grayscale value to the first compensation value C_GRAY1) has a relatively large value with respect to the monochrome image (compared to the white image), the third compensation value C_GRAY3 may have a relatively large value (e.g., a value similar to the second compensation value C_GRAY2), as illustrated in FIG. 16B, thus enabling the input grayscale value GRAY_IN to be sufficiently compensated for.

As described above with reference to FIGS. 15 to 16B, the second data compensator 220_1 according to embodiments of the present disclosure may vary the compensation value (i.e., the third compensation value C_GRAY3 as a compensation value which is finally reflected in the input grayscale value GRAY_IN) in response to a change in lateral leakage, thus preventing deterioration of display quality.

Figure 17:
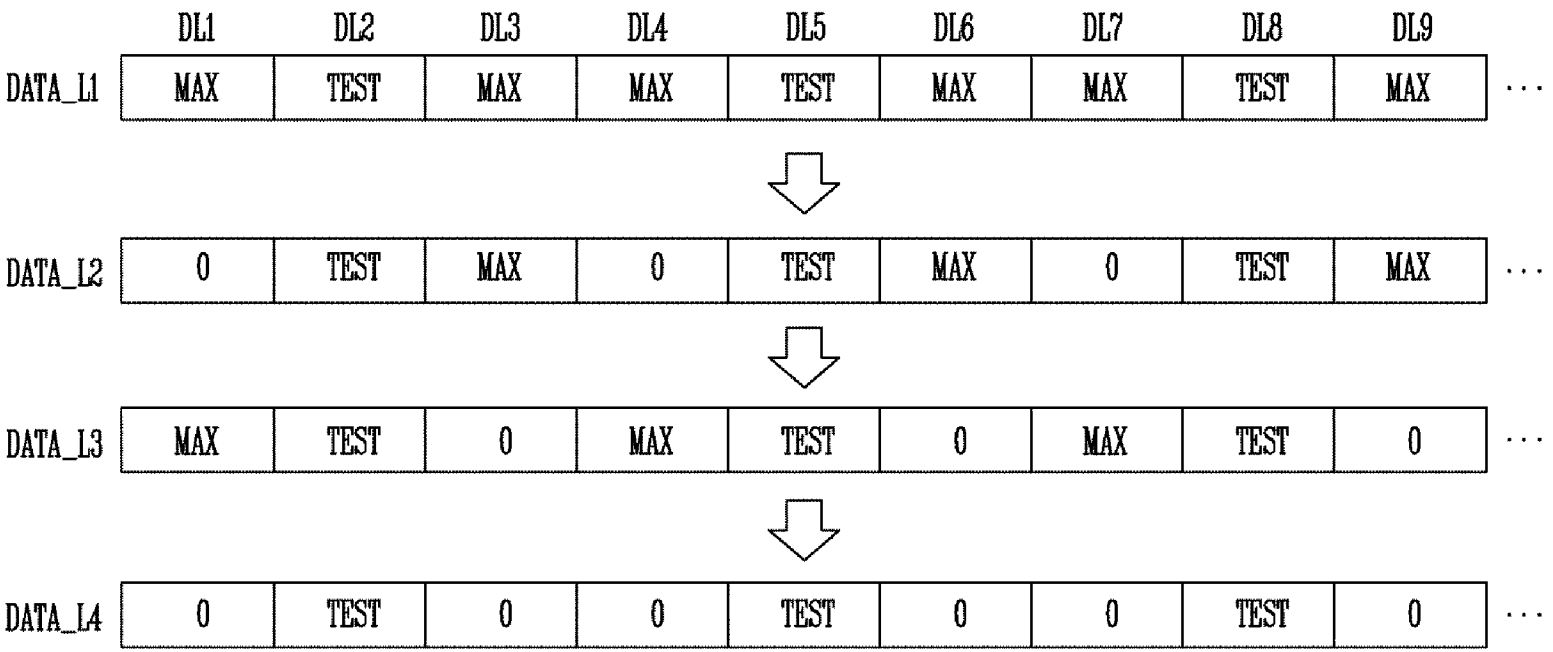
FIG. 17 is a diagram illustrating an example of test data provided to the controller of FIG. 5.

FIG. 17 is a diagram illustrating an example of test data provided to the controller of FIG. 5. In FIG. 17, pieces of line data DATA_L1 to DATA_L4 for pixels included in a single row in a display unit 110 are depicted in a temporal sequence.

Referring to FIGS. 1 and 17, data signals corresponding to pieces of line data DATA_L1 to DATA_L4 may be provided to the display unit 110 through data lines DL1 to DLm illustrated in FIG. 1.

Each of the pieces of line data DATA_L1 to DATA_L4 may include data values that are repeated every three data lines. Therefore, the pieces of line data DATA_L1 to DATA_L4 will be described based on the first to third data lines DL1 to DL3.

The pieces of line data DATA_L1 to DATA_L4 may have a test value TEST in accordance with the second data line DL2, and may have a minimum grayscale value or maximum grayscale value MAX in accordance with the first and third data lines DL1 and DL3. For example, the test value TEST may be an arbitrary grayscale value included in the second low grayscale range, described above with reference to FIG. 6, and may have a grayscale value of, for example, 15. For example, the minimum grayscale value may be a grayscale value of 0, and the maximum grayscale value MAX may be a grayscale value of 255.

The first line data DATA_L1 may have the maximum grayscale value MAX in accordance with the first and third data lines DL1 and DL3. The second line data DATA_L2 may have the minimum grayscale value in accordance with the first data line DL1 and have the maximum grayscale value MAX in accordance with the third data line DL3. The third line data DATA_L3 may have the maximum grayscale value MAX in accordance with the first data line DL1 and have the minimum grayscale value MIN in accordance with the third data line DL3. The fourth line data DATA_L4 may be identical to the first line data DATA_L1.

The display device 1 (or the controller 140) may compensate for the grayscale value of a target pixel using adjacent grayscale values of adjacent pixels. Accordingly, the grayscale value (or the compensated grayscale value GRAY_C) corresponding to the second data line DL2 changes depending on change in the grayscale values corresponding to the first and third data lines DL1 and DL3, thus enabling change in the luminance of the pixel included in the second data line DL2 to be checked.

Meanwhile, although, in FIG. 17, data signals respectively corresponding to the first line data DATA_L1 to the fourth line data DATA_L4 have been described as being provided to the display unit 110, the present disclosure is not limited thereto.

For example, the first line data DATA_L1 and the second line data DATA_L2 may be combined with each other, so that a grayscale value corresponding to the first data line DL1 (and the fourth data line DL4 and the seventh data line DL7) may change, in stages, within a range from the maximum grayscale value MAX (or a specific grayscale value, e.g., a grayscale value of 30) to the minimum grayscale value. Also, a grayscale value corresponding to the third data line DL3 (and the sixth data line DL6 and the ninth data line DL9) may also change in stages. That is, the test data may correspond to a gradation image.

Figure 18:
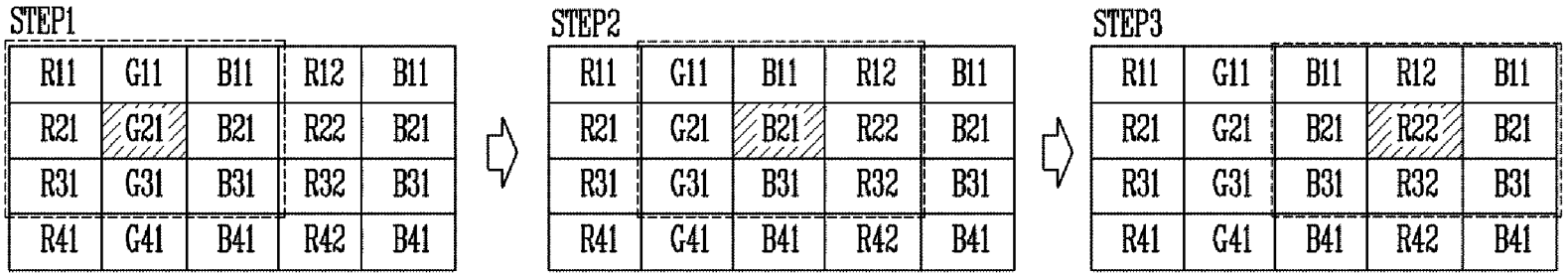
FIG. 18 is a diagram illustrating an example of a process in which the controller of FIG. 5 compensates for a gray-scale value using the compensation filter of FIG. 9A.

FIG. 18 is a diagram illustrating an example of a process in which the controller of FIG. 5 compensates for a grayscale value using the compensation filter of FIG. 9A. In FIG. 18, pixels in the first area A1 of FIG. 1 are exemplary illustrated, wherein the pixels may be arranged in a stripe structure.

Referring to FIGS. 10 and 18, the pixels of FIG. 18 are different from pixels having an RGBG pentile structure illustrated in FIG. 10 in that the pixels illustrated in FIG. 18 have an RGB stripe structure.

As described above with reference to FIG. 10, at the first to third steps STEP1 to STEP3, the controller 140 (or the data converter 200 of FIG. 5) may repeatedly perform the calculation of the compensation value or the compensated grayscale value GRAY_C while moving the compensation filter FILTER1, described above with reference to FIG. 9A, on a pixel basis.

That is, the display device 1 may perform grayscale compensation on input image data regardless of the array structure of pixels in a display unit 110.

Figures 19, 20:
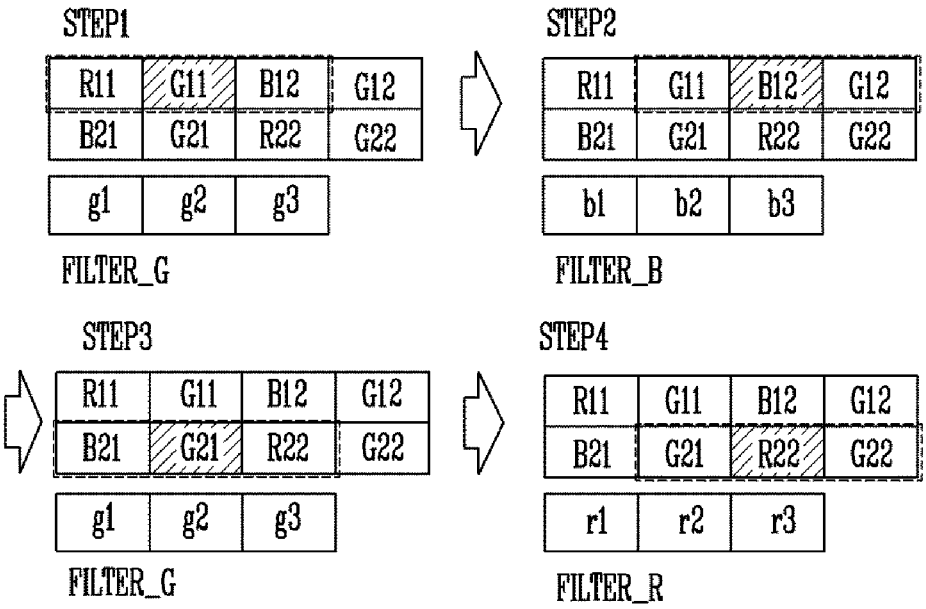
FIG. 19 is a diagram illustrating various examples of a compensation filter used in the second data compensator included in the controller of FIG. 5.
FIG. 20 is a diagram illustrating an example of a compensation filter used in the second data compensator in the controller of FIG. 5.

FIG. 19 is a diagram illustrating various examples of a compensation filter used in the second data compensator included in the controller of FIG. 5.

Referring to FIG. 19, a first line compensation filter FILTER_L1 is different from the compensation filter FIL- TER1, described above with reference to FIG. 9A or the like in that FILTER_L1 has a size of 1 row*3 columns.

In the first line compensation filter FILTER_L1, the size of a line memory for storing adjacent grayscale values of adjacent pixels may be reduced, or alternatively, the line memory may be removed.

When the second data compensator 220 or 220_1 uses the first line compensation filter FILTER_L1, LLF(i,j) included in Equations (3), (4), and (5) may be calculated using the following Equation (6).

$$LLF(i,j)=c1\times GRAYij-1+c0\times GRAYij+c2\times GRAYij+1+a \quad (6)$$

Here, c0 may be a reference compensation coefficient for the input grayscale value GRAY_IN, and c1 and c2 may be respective compensation coefficients of adjacent grayscale values.

Meanwhile, a second line compensation filter FILTER_L2 may have a size of 1 row*5 columns.

When the second data compensator 220 or 220_1 uses the second line compensation filter FILTER_L2, LLF(i,j) included in Equations (3), (4), and (5) may be calculated using the following Equation (7).

$$LLF(i,j)=d1\times GRAYij-2+d2\times GRAYij-1+d0\times GRAYij+d3\times GRAYij+1+d4\times GRAYij+2+a \quad (7)$$

Here, d0 may be a reference compensation coefficient for the input grayscale value GRAY_IN, and d1 to d4 may be respective compensation coefficients of adjacent grayscale values.

Meanwhile, a third line compensation filter FILTER_L3 may have a size of 1 row*6 columns.

When the second data compensator 220 or 220_1 uses the third line compensation filter FILTER_L3, LLF(i,j) included in Equations (3), (4), and (5) may be calculated using the following Equation (8).

$$LLF(0)=e1\times GRAYij-3+e2\times GRAYij-2+e3\times GRAYij-1+e0\times GRAYij+e4\times GRAYij+1+e5\times GRAYij+2+a \quad (8)$$

Here, e0 may be a reference compensation coefficient for the input grayscale value GRAY_IN, and e1 to e5 may be respective compensation coefficients of adjacent grayscale values.

As described above with reference to FIG. 19, the compensation filter may be implemented as a 1 row*k column-line compensation filter corresponding to one row (i.e., one of the first to third line compensation filters FILTER_L1, FILTER_L2, and FILTER_L3), and the size of the line compensation filter may be changed in various forms, wherein k may be, for example, a value equal or greater than 3.

FIG. 20 is a diagram illustrating an example of a compensation filter used in the second data compensator included in the controller of FIG. 5.

Referring to FIGS. 9A, 9B, 10, 11, and 20, compensation filters FILTER_G, FILTER_B, and FILTER_R illustrated in FIG. 20 are different from the compensation filter FILTER, described above with reference to FIG. 9A or the like, in that the compensation filters have a size of 1 row*3 columns.

In exemplary embodiments, the compensation filters FILTER_G, FILTER_B and FILTER_R may be identical to or different from each other. For example, each of the compensation filters FILTER_G, FILTER_B and FILTER_R may have compensation coefficients (e.g., 0.125, 0, 0.125) identical to those in the second row of the first compensation filter FILTER_S1, described above with reference to FIG. 9B. In an example, the green compensation filter FILTER_G may have compensation coefficients (e.g., 0.125, 0, 0.125) identical to those in the second row of the first compensation filter FILTER_S1, described above with reference to FIG. 9B, and the blue and red compensation filters FILTER_B and FILTER_R may have compensation coefficients (e.g., 0.1, 0, 0.1) identical to those in the second row of the second compensation filter FILTER_S2, described above with reference to FIG. 9B.

Figure 21:
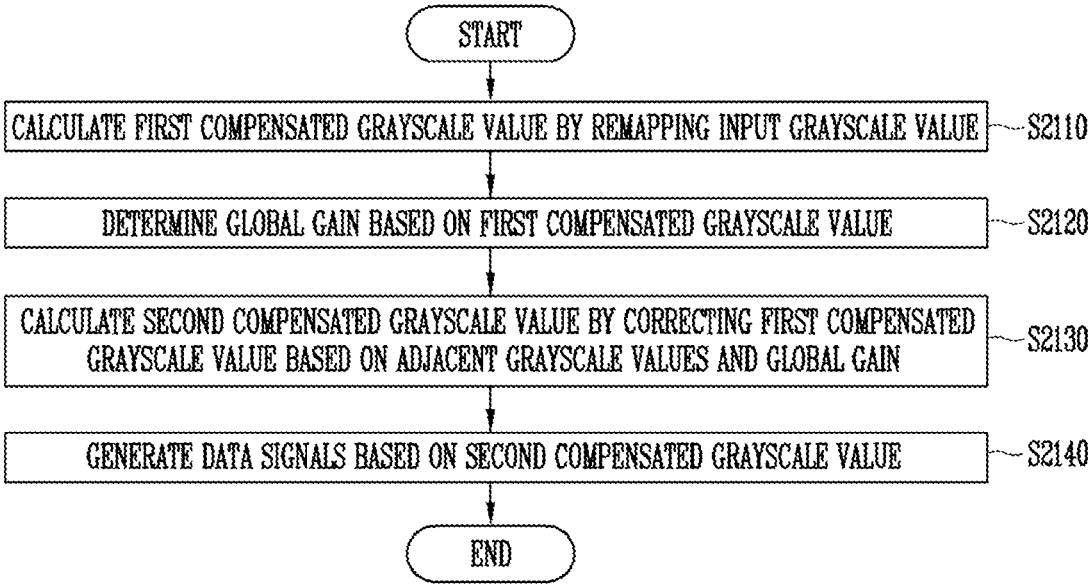
FIG. 21 is a flowchart illustrating a method of driving a display device according to an exemplary embodiment of the invention.

FIG. 21 is a flowchart illustrating a method of driving a display device according to an exemplary embodiment of the invention.

Referring to FIGS. 1 and 21, the method of FIG. 21 may be performed by a display device 1 of FIG. 1.

The method of FIG. 21 may calculate a remapped grayscale value GRAY_RE (or first compensated grayscale value) by remapping an input grayscale value included in input image data RGB at step S2110.

As described above with reference to FIGS. 6 and 7, the method of FIG. 21 may calculate the remapped grayscale value GRAY_RE by remapping the input grayscale value GRAY_IN from a first grayscale range to a second grayscale range using Equation (1) or a lookup table LUT.

Thereafter, the method of FIG. 21 may determine a global gain based on the first compensated grayscale value at step S2120. Here, the global gain may be the first gain G, described above with reference to Equation (2) and FIG. 12.

As described above with reference to FIG. 12, the method of FIG. 21 may decrease the global gain (or the first gain G) as the remapped grayscale value GRAY_RE becomes larger.

Next, the method of FIG. 21 may determine a dimming gain based on the dimming level of the display device 1. Here, the dimming gain may be the second gain D, described above with reference to Equation (2) and FIG. 13.

As described above with reference to FIG. 13, the method of FIG. 21 may decrease the dimming gain (or the second gain D) as the dimming level becomes higher.

Thereafter, the method of FIG. 21 may calculate a compensated grayscale value GRAY_C (or second compensated grayscale value) by correcting the remapped grayscale value GRAY_RE based on adjacent grayscale values and the global gain at step S2130.

The method of FIG. 21 may calculate the compensated grayscale value GRAY_C using the above-described Equation (2). Further, the compensated grayscale value GRAY_C (or compensation value) may be calculated using at least one of the compensation filters, described above with reference to FIGS. 9A, 9B, and 20. Furthermore, the method of FIG. 21 may continuously calculate the compensated grayscale value GRAY_C while moving the corresponding compensation filter on a pixel basis, as described above with reference to FIGS. 10, 11, and 20. The compensated grayscale value GRAY_C may be included in image data DATA, described above with reference to FIG. 1, and the image data DATA may be provided to the data driver 120.

Thereafter, the method of FIG. 21 may generate data signals based on the second compensated grayscale value at step S2140.

As described above with reference to FIG. 1, the data driver 120 may generate the data signals based on the image data DATA, that is, the compensated grayscale value GRAY_C included in the image data DATA, and may provide the data signal to the display unit 110 through the data lines DL1 to DLm.

Figure 22:
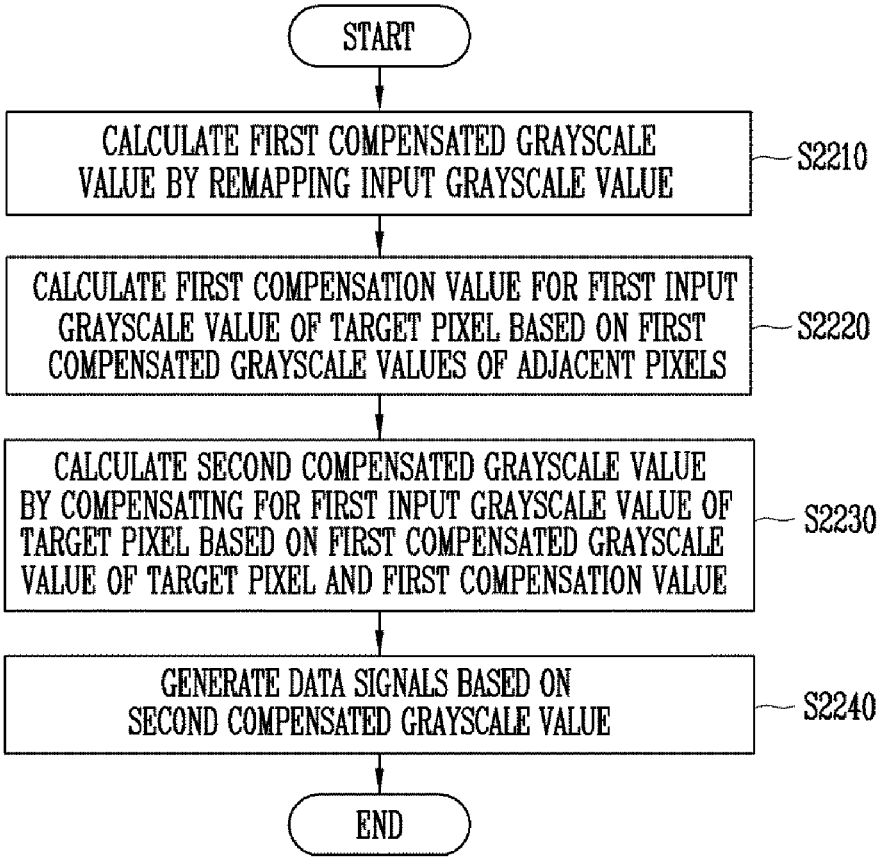
FIG. 22 is a flowchart illustrating a method of driving a display device according to an exemplary embodiment of the invention.

FIG. 22 is a flowchart illustrating a method of driving a display device according to an exemplary embodiment of the invention.

Referring to FIGS. 1 and 22, the method of FIG. 22 may be performed by the display device 1 of FIG. 1.

The method of FIG. 22 may remap an input grayscale value included in input image data RGB and then calculate a remapped grayscale value GRAY_RE (or a first compensated grayscale value) at step S2210.

As described above with reference to FIGS. 6 and 7, the method of FIG. 22 may remap the input grayscale value GRAY_IN within a first grayscale range to the first compensated grayscale value GRAY_RE within a second grayscale range using Equation (1) or a lookup table (LUT).

Thereafter, the method of FIG. 22 may calculate a first compensation value for a first input grayscale value of a target pixel based on first compensated grayscale values of adjacent pixels at step S2220.

The method of FIG. 22 may calculate a first compensation value C_GRAY1 using the above-described Equation (3) (or Equation (4)), and may also calculate the first compensation value C_GRAY1 using at least one of the compensation filters described above with reference to FIGS. 9A, 9B, and 19. Also, the method of FIG. 22 may continuously calculate the first compensation value C_GRAY1 while moving the compensation filter on a pixel basis, as described above with reference to FIG. 10.

The method of FIG. 22 may calculate a second compensated grayscale value GRAY_C2 by compensating for the first input grayscale value GRAY_IN of the target pixel based on the first compensated grayscale value GRAY_C1 of the target pixel and the first compensation value C_GRAY1 at step S2230.

In embodiments, the method of FIG. 22 may calculate a difference value by subtracting the input grayscale value GRAY_IN of the target pixel from the first compensated grayscale value GRAY_C1 of the target pixel, may calculate a second compensation value C_GRAY2 by subtracting the first compensation value C_GRAY1 from the absolute value of the difference value, and may calculate a second compensated grayscale value GRAY_C2 of the target pixel based on the input grayscale value GRAY_IN and the second compensation value C_GRAY2, as described above with reference to FIGS. 14 and 15. The second compensated grayscale value GRAY_C2 may be included, as a compensated grayscale value GRAY, in the image data DATA, described above with reference to FIG. 1, and the image data DATA may be provided to the data driver 120.

In an embodiment, the method of FIG. 22 may calculate a gain by dividing the input grayscale value GRAY_IN by the first compensation value C_GRAY1, and may calculate a third compensation value C_GRAY3 by multiplying the second compensation value C_GRAY2 by the gain, as described above with reference to FIG. 15. In this case, a third compensated grayscale value GRAY_C3 may be included, as the compensated grayscale value GRAY, in the image data DATA, described above with reference to FIG. 1, and the image data DATA may be provided to the data driver 120.

Thereafter, the method of FIG. 22 may generate data signals based on the second compensated grayscale value (or the third compensated grayscale value) at step S2240.

The display device and the method of driving the display device according to embodiments of the invention may compensate for the degradation of gamma characteristics of respective pixels by remapping grayscale values in a low grayscale range, and may correct distortion (improperness) in white balance of the pixels by compensating for the remapped grayscale values based on adjacent grayscale values. Therefore, the deterioration of display quality in a low grayscale range may be mitigated or prevented.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device, comprising:

a display unit having a plurality of pixels including a target pixel and adjacent pixels disposed in proximity to the target pixel;

a data converter to:

receive grayscale values respectively corresponding to the plurality of pixels;

generate first compensated grayscale values by remapping the grayscale values of a first grayscale range to the first compensated grayscale value of a second grayscale range; and generate second compensated grayscale values by compensating for the first compensated grayscale values based on first compensated grayscale values of the adjacent pixels; and a data driver to generate data signals based on the second compensated grayscale values and provide the data signals to the plurality of pixels of the display unit, wherein at least one of the adjacent pixels is configured to emit light having a color different from that of the target pixel, and wherein the data converter is configured to generate a second compensated grayscale value of the target pixel by decreasing a first compensated grayscale value of the target pixel in response to one of the adjacent grayscale values being increased.

2. The display device according to claim 1, wherein the first grayscale range is a subset of the second grayscale range.

3. The display device according to claim 2, wherein:

the first grayscale range comprises a first low grayscale range and the second grayscale range comprises a second low grayscale range, the first low grayscale range being a subset of the second low grayscale, and the data converter is configured to remap the grayscale values in the first low grayscale range to the first compensated grayscale value in the second low grayscale range.

4. The display device according to claim 3, wherein the data converter is configured to generate the first compensated grayscale values based on a lookup table including mapping information between the first low grayscale values and the second low grayscale values.

5. The display device according to claim 1, wherein the data converter is configured to:

calculate a compensation value for the target pixel based on the first compensated grayscale values of the adjacent pixels; and calculate the second compensated grayscale value of the target pixel by subtracting the compensation value from the first compensated grayscale value of the target pixel.

6. The display device according to claim 5, wherein the data converter is configured to calculate the compensation value by computing a weighted sum of the first compensated grayscale values of the adjacent pixels based on preset compensation coefficients.

7. The display device according to claim 6, wherein a first compensation coefficient corresponding to a first adjacent pixel of the adjacent pixels that is in a row identical to that of the target pixel is different from a second compensation coefficient corresponding to a second adjacent pixel of the adjacent pixels that is in a column identical to that of the target pixel.

8. The display device according to claim 7, wherein the first compensation coefficient is greater than the second compensation coefficient.

9. The display device according to claim 6, wherein the compensation value is inversely proportional to the first compensated grayscale value.

10. The display device according to claim 9, wherein the compensation value is inversely proportional to a total maximum luminance of the plurality of pixels.

11. The display device according to claim 6, wherein:

the plurality of pixels comprises a first pixel to emit light in a first color, a second pixel to emit light in a second color, and a third pixel to emit light in a third color, the data converter is configured to calculate a first compensation value of the first pixel using a first compensation filter including first compensation coefficients, and calculate a second compensation value of the second pixel using a second compensation filter including second compensation coefficients, and the second compensation filter is different from the first compensation filter.

12. The display device according to claim 1, wherein the adjacent pixels are included in the same row as that of the target pixel.

13. A method of driving a display device having a plurality of pixels including a target pixel and adjacent pixels disposed in proximity to the target pixel, the method comprising:

generating first compensated grayscale values by remapping respective input grayscale values from a first grayscale range to a second grayscale range;

generating second compensated grayscale values by compensating for remapped grayscale values based on remapped grayscale values of the adjacent pixels, such that, in response to one of the adjacent grayscale values being increased, the second compensated grayscale value of the target pixel is decreased;

generating data signals based on the second compensated grayscale values; and emitting, by at least one of the adjacent pixels, light having a color different from that of the target pixel.

14. A method having a plurality of pixels including a target pixel and adjacent pixels disposed in proximity to the target pixel, the method comprising:

generating first compensated grayscale values by remapping respective input grayscale values from a first grayscale range to a second grayscale range, the remapping comprising:

determining a global gain for the target pixel based on a first compensated grayscale value of the target pixel; and calculating a second compensated grayscale value of the target pixel based on the global gain and the first compensated grayscale values of the adjacent grayscale;

generating second compensated grayscale values by compensating for remapped grayscale values based on remapped grayscale values of the adjacent pixels;

generating data signals based on the second compensated grayscale values; and emitting, by at least one of the adjacent pixels, light having a color different from that of the target pixel.

15. A display device, comprising:

a display unit including having a plurality of pixels including a target pixel and adjacent pixels disposed in proximity to the target pixel;

a data converter to:

receive grayscale values respectively corresponding to the plurality of pixels;

remap the grayscale values of a first grayscale range to first compensated grayscale values of a second grayscale range;

generate second compensated grayscale values by compensating for the grayscale values based on first compensated grayscale values of the adjacent pixels;

calculate a difference value by subtracting a grayscale value of the target pixel from a first compensated grayscale value of the target pixel;

calculate a first compensation value for the target pixel based on the first compensated grayscale values of the adjacent pixels;

calculate a second compensation value by subtracting the first compensation value from an absolute value of the difference value;

calculate a second compensated grayscale value of the target pixel based on the grayscale value and the second compensation value, and a data driver to generate data signals based on the second compensated grayscale values and provide the data signals to the plurality of pixels, wherein at least one of the adjacent pixels is configured to emit light in a color different from that of the target pixel, and wherein the data converter is configured to increase the first compensation value as one of the first compensated grayscale values of the adjacent pixels is increased.

16. The display device according to claim 15, wherein the second grayscale range is a subset of the first grayscale range.

17. The display device according to claim 15, wherein the data converter is configured to set the first compensation value to the second compensated grayscale value in response to the first compensation value being less than 0.

18. The display device according to claim 15, wherein the data converter is configured to calculate the first compensation value by computing a weighted sum of the adjacent grayscale values based on compensation coefficients that are preset in accordance with the respective adjacent grayscale values.

19. The display device according to claim 18, wherein a first compensation coefficient for a first adjacent pixel of the adjacent pixels that is in a row identical to that of the target pixel is different from a second compensation coefficient for a second adjacent pixel of the adjacent pixels that is in a column identical to that of the target pixel, among the adjacent pixels.

20. The display device according to claim 18, wherein the data converter is configured to calculate the second compensated grayscale value by adding the first compensated grayscale value to the second compensation value in response to the difference value being greater than 0.

21. The display device according to claim 20, wherein the data converter is configured to calculate the second compensated grayscale value by subtracting the second compensation value from the first compensated grayscale value in response to the difference value being less than 0.

22. The display device according to claim 15, wherein the first compensation value is proportional to the grayscale value of the target pixel and is inversely proportional to the first compensated grayscale value.

* * * * *